US008194112B2

(12) United States Patent
Sowa et al.

(10) Patent No.: US 8,194,112 B2
(45) **Date of Patent: *Jun. 5, 2012**

(54) LINE HEAD AND IMAGE FORMING APPARATUS

(75) Inventors: Takeshi Sowa, Matsumoto (JP); Yujiro Nomura, Shiojiri (JP); Ryuta Koizumi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 214 days.

This patent is subject to a terminal disclaimer.

(21) Appl. No.: 12/628,838

(22) Filed: Dec. 1, 2009

(65) Prior Publication Data

US 2010/0183338 A1 Jul. 22, 2010

(30) Foreign Application Priority Data

Jan. 19, 2009 (JP) ..... 2009-009384

(51) Int. Cl.
*B41J 2/45* (2006.01)

(52) U.S. Cl. ..... 347/238

(58) Field of Classification Search ..... 347/230, 347/241, 244, 256, 258, 238; 359/721
See application file for complete search history.

(56) References Cited

U.S. PATENT DOCUMENTS

| | | | | |
|---|---|---|---|---|
| 5,023,442 | A | 6/1991 | Taniguchi et al. | 250/208.1 |
| 5,444,520 | A | 8/1995 | Murano | |
| 5,771,062 | A | 6/1998 | Nomura et al. | |
| 5,808,775 | A * | 9/1998 | Inagaki et al. | 359/197.1 |
| 6,445,483 | B2 | 9/2002 | Takada et al. | |
| 6,798,440 | B2 | 9/2004 | Yasuda | |
| 7,733,363 | B2 | 6/2010 | Sowa et al. | |
| 7,760,215 | B2 | 7/2010 | Inoue et al. | |
| 7,835,082 | B2 | 11/2010 | Tsujino et al. | |
| 7,898,738 | B2 | 3/2011 | Yamamura | |
| 7,907,162 | B2 | 3/2011 | Inoue et al. | |
| 7,998,085 | B2 | 8/2011 | Bryant | |
| 8,022,975 | B2 | 9/2011 | Sowa et al. | |
| 8,089,499 | B2 | 1/2012 | Sowa et al. | |
| 8,089,695 | B2 | 1/2012 | Sowa et al. | |
| 2008/0025759 | A1 | 1/2008 | Ichii et al. | |
| 2008/0225399 | A1 | 9/2008 | Tsujino et al. | |

(Continued)

FOREIGN PATENT DOCUMENTS

EP 2028014 A2 * 2/2009

(Continued)

OTHER PUBLICATIONS

U.S. notice of allowance dated Feb. 15, 2012 issued in related U.S. Appl. No. 12/688,697 cites the U.S. patents, U.S. patent application publications and foreign patent documents above.

*Primary Examiner* — Hai C Pham
(74) *Attorney, Agent, or Firm* — DLA Piper LLP (US)

(57) ABSTRACT

An image forming apparatus includes a latent image carrier on which a latent image is formed; and a line head. The line head includes light-emitting elements arranged in a first direction; an aperture diaphragm; and an optical system that images light emitted from the light-emitting elements on a latent image carrier. The aperture diaphragm and the optical system are arranged in a second direction that is orthogonal to or substantially orthogonal to the first direction; and among the lenses included in the optical system, a lens located at the position closest to the aperture diaphragm is a multifocal lens.

8 Claims, 11 Drawing Sheets

U.S. PATENT DOCUMENTS

| | | | |
|---|---|---|---|
| 2009/0021571 | A1 | 1/2009 | Inoue et al. |
| 2009/0052943 | A1 | 2/2009 | Sowa et al. |
| 2009/0066779 | A1 | 3/2009 | Sowa et al. |
| 2009/0067055 | A1 | 3/2009 | Yamamura |
| 2009/0086328 | A1 | 4/2009 | Sowa et al. |
| 2009/0091611 | A1 | 4/2009 | Sowa et al. |
| 2009/0129818 | A1 | 5/2009 | Inoue et al. |
| 2009/0153643 | A1 | 6/2009 | Nomura et al. |
| 2009/0237458 | A1 | 9/2009 | Silverbrook |
| 2010/0183336 | A1* | 7/2010 | Sowa et al. ..... 399/218 |
| 2011/0123210 | A1 | 5/2011 | Nomura et al. |
| 2011/0216418 | A1 | 9/2011 | Shiraishi |

FOREIGN PATENT DOCUMENTS

| | | |
|---|---|---|
| JP | 02-004546 | 1/1990 |
| JP | 06278314 A | 10/1994 |
| JP | 06344596 A | 12/1994 |

* cited by examiner

EXAMPLE (PRESENT INVENTION)

COMPARATIVE EXAMPLE (CONVENTIONAL TECHNIQUE)

LINE HEAD AND IMAGE FORMING APPARATUS

BACKGROUND

1. Technical Field

The present invention relates to a line head and an image forming apparatus.

2. Related Art

Electrophotographic image forming apparatuses such as copying machines or printers are provided with an exposure unit that performs an exposure process on an outer surface of a rotating photoconductor so as to form an electrostatic latent image thereon. As the exposure unit, a line head having a structure in which a plurality of light-emitting elements is arranged in the direction of the rotation axis) of the photoconductor is known (for example, see JP-A-2-4546)

As the line head, for example, JP-A-2-4546 describes an optical information writer in which a plurality of LED array chips with a plurality of LEDs (light-emitting elements) is arranged in one direction.

In the optical information writer, the plurality of LEDs of each of the LED array chips is arranged in the direction of the rotation axis of the photoconductor. Convex lens elements (optical systems) are provided so as to correspond to the respective LED array chips. The convex lens elements image the light from the respective LEDs of each of the LED array chips.

In the line head described in JP-A-2-4546, due to the image-surface curvature of the convex lens element, the imaging capability of the convex lens element decreases as it becomes distant from the optical axis. On the surface of the photoconductor, a spot size (diameter) of light from an LED which is located close to the optical axis of the convex lens element is different from a spot size of light from an LED which is located distant from the optical axis of the convex lens element. As a result, the concentration of the latent image formed on the surface of the photoconductor becomes different between pixels, which are formed by the light from the LED located close to the optical axis of the convex lens element, and pixels, which are formed by the light from the LED located distant from the optical axis of the convex lens element, whereby concentration unevenness occurs.

Furthermore, the positional relationship between the image surface of the convex lens element and the light irradiation surface (the surface of the photoconductor) is offset or varied due to errors in mounting the line head onto the body of the image forming apparatus, eccentricity of the photoconductor, or the like. In this respect, concentration unevenness will occur.

SUMMARY

An advantage of some aspects of the invention is that it provides a line head capable of performing a high-accuracy exposure process and an image forming apparatus capable of obtaining a high-quality image.

The above-described advantage is achieved by the following aspects and embodiments of the invention.

According to an aspect of the invention, there is provided a line head including: light-emitting elements arranged in a first direction; an aperture diaphragm; and an optical system that images light emitted from the light-emitting elements on an image surface, wherein: the aperture diaphragm and the optical system are arranged in a second direction that is orthogonal to or substantially orthogonal to the first direction; and among the lenses included in the optical system, a lens located at the position closest to the aperture diaphragm is a multifocal lens.

In an embodiment of the line head of the above aspect of the invention, the multifocal lens may have a lens surface including a first region and a second region which are defined by different definition formulas.

In another embodiment of the line head of the above aspect of the invention, the first region may be provided in a central portion of the lens surface, and the second region may be provided so as to surround the periphery of the first region.

In another embodiment of the line head of the above aspect of the invention, the lens surface may have a rotationally symmetrical shape.

In another embodiment of the line head of the above aspect of the invention, the lens surface including the first region and the second region may be a lens surface which is located at the position closest to the light-emitting elements.

In another embodiment of the line head of the above aspect of the invention, the first region may have a larger area than the second region.

In another embodiment of the line head of the above aspect of the invention, the optical system may have imaging points which are located at different positions in the second direction. A distance in the second direction between a imaging point, which is located furthest from the optical system in the second direction among the imaging points, and a imaging point, which is located closest to the optical system in the second direction, may be larger than the minimum spot size of light which is emitted from the light-emitting elements to converge in the optical system.

According to another aspect of the invention, there is provided an image forming apparatus including: a latent image carrier on which a latent image is formed; and a line head, the line head including: light-emitting elements arranged in a first direction; an aperture diaphragm; and an optical system that images light emitted from the light-emitting elements on a latent image carrier, wherein: the aperture diaphragm and the optical system are arranged in a second direction that is orthogonal to or substantially orthogonal to the first direction; and among the lenses included in the optical system, a lens located at the position closest to the aperture diaphragm is a multifocal lens.

According to the line head of the aspects and embodiments of the invention having the above-described configuration, since the optical system has the lens (multifocal lens) having a plurality of focal points, when the light emitted from the light-emitting element is imaged by the optical system, it is possible to make the spot size of the light substantially constant over a relatively wide range in the optical axis direction in the vicinity of the image surface. Therefore, even when the positional relationship in the optical axis direction between the image surface and the light irradiation surface, is changed or offset, it is possible to prevent a variation of the spot size on the light irradiation surface. As a result, it is possible to prevent concentration unevenness in the formed latent image. In particular, since the lens (multifocal lens) having a plurality of focal points is located closest to the side of the aperture diaphragm (the side of the light-emitting elements), the optical system can reliably exhibit the above-described characteristics even when the light-emitting elements are located at different distances from the optical axis (namely, even when the angles of view are different). Therefore, the line head of the invention is able to realize a high-accuracy exposure process.

Moreover, according to the image forming apparatus of the aspect of the invention, by realizing the above-described high-accuracy exposure process, it is possible to obtain a high-quality image in which concentration unevenness is suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a line head and an image forming apparatus according to preferred embodiments of the invention will be described in detail with reference to the accompanying drawings.

Figure 1:
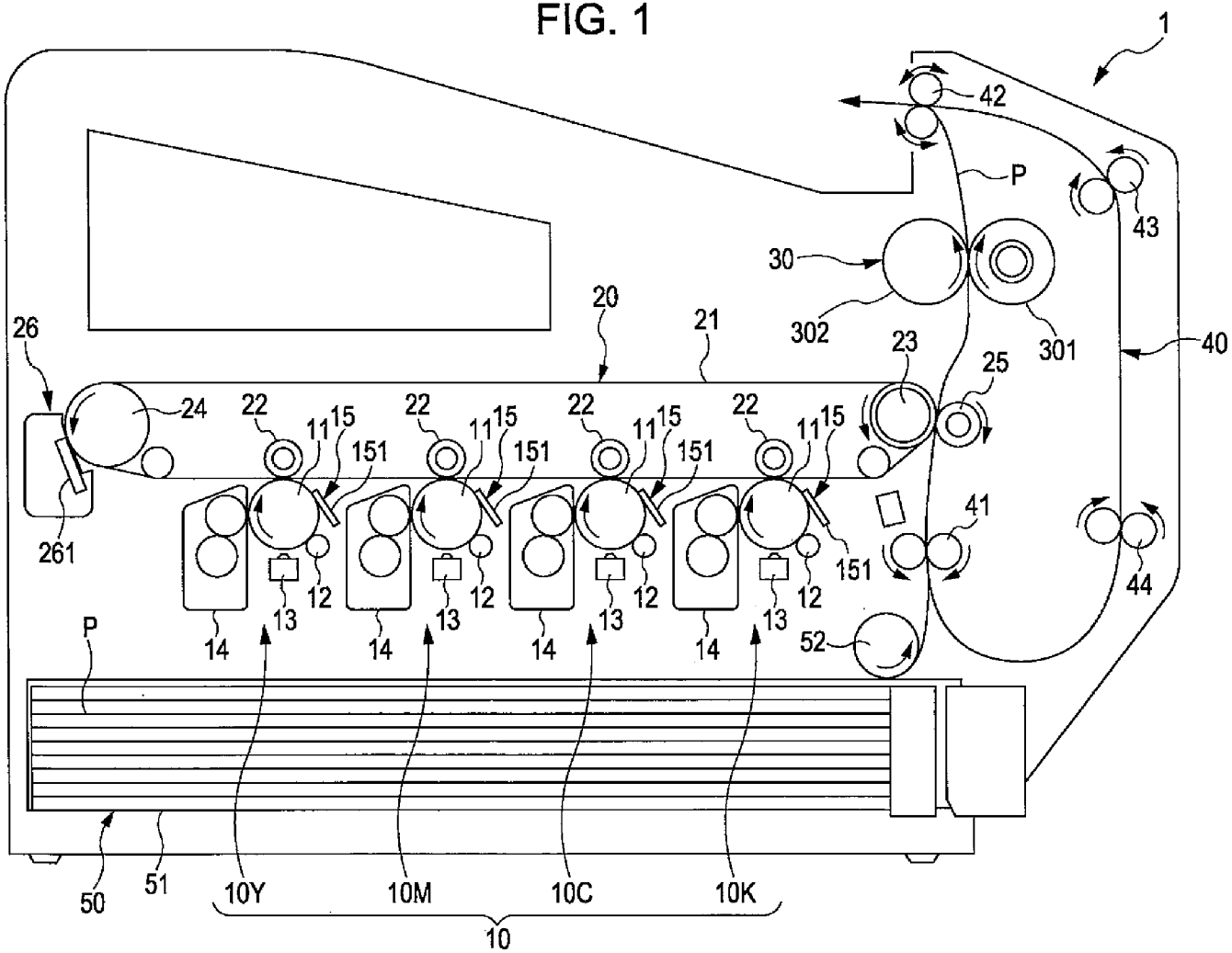
FIG. 1 is a schematic view illustrating the entire configuration of an image forming apparatus according to an embodiment of the invention.
Figure 2:
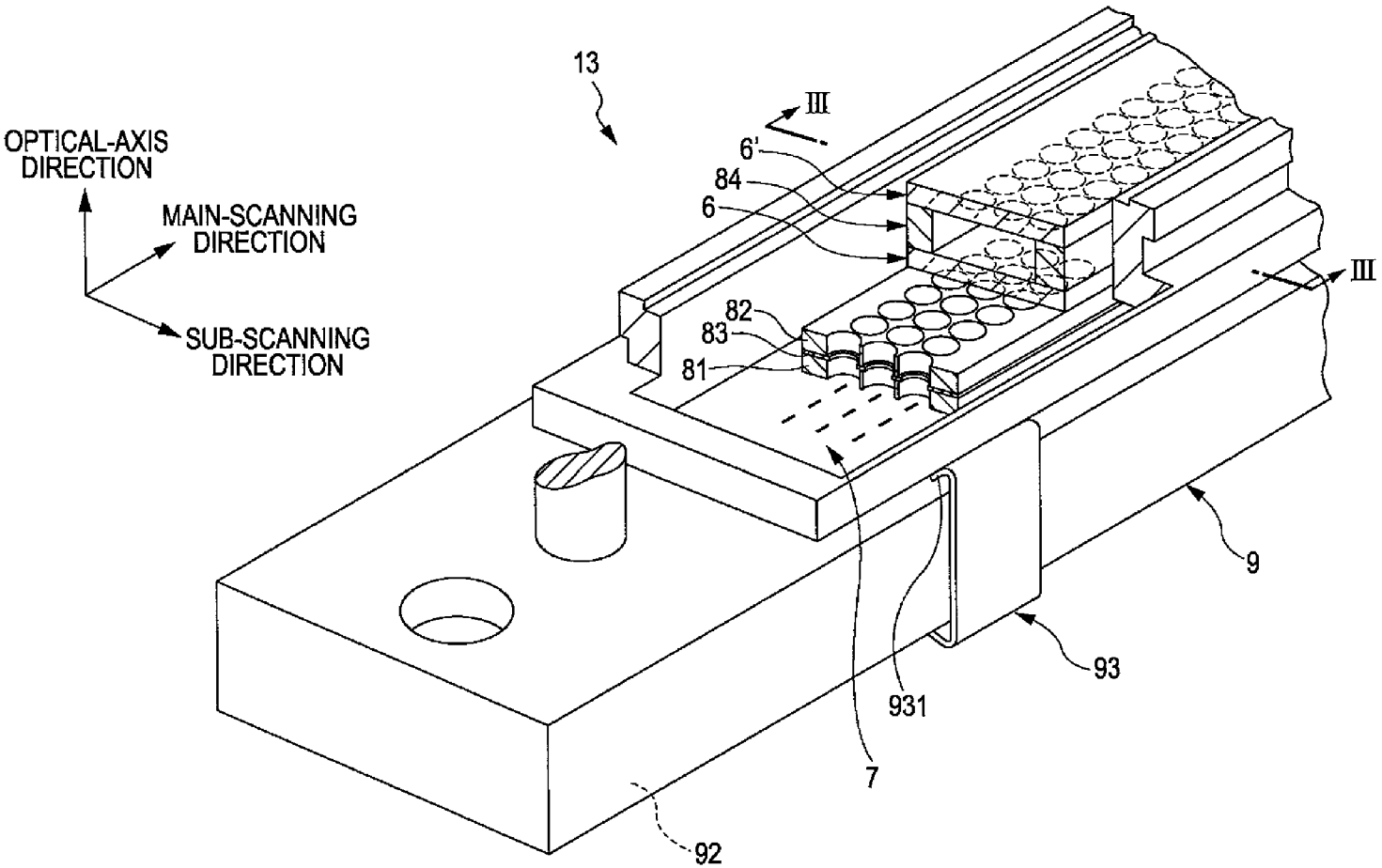
FIG. 2 is a partially sectional perspective view illustrating a line head included in the image forming apparatus illustrated in FIG. 1.
Figure 3:
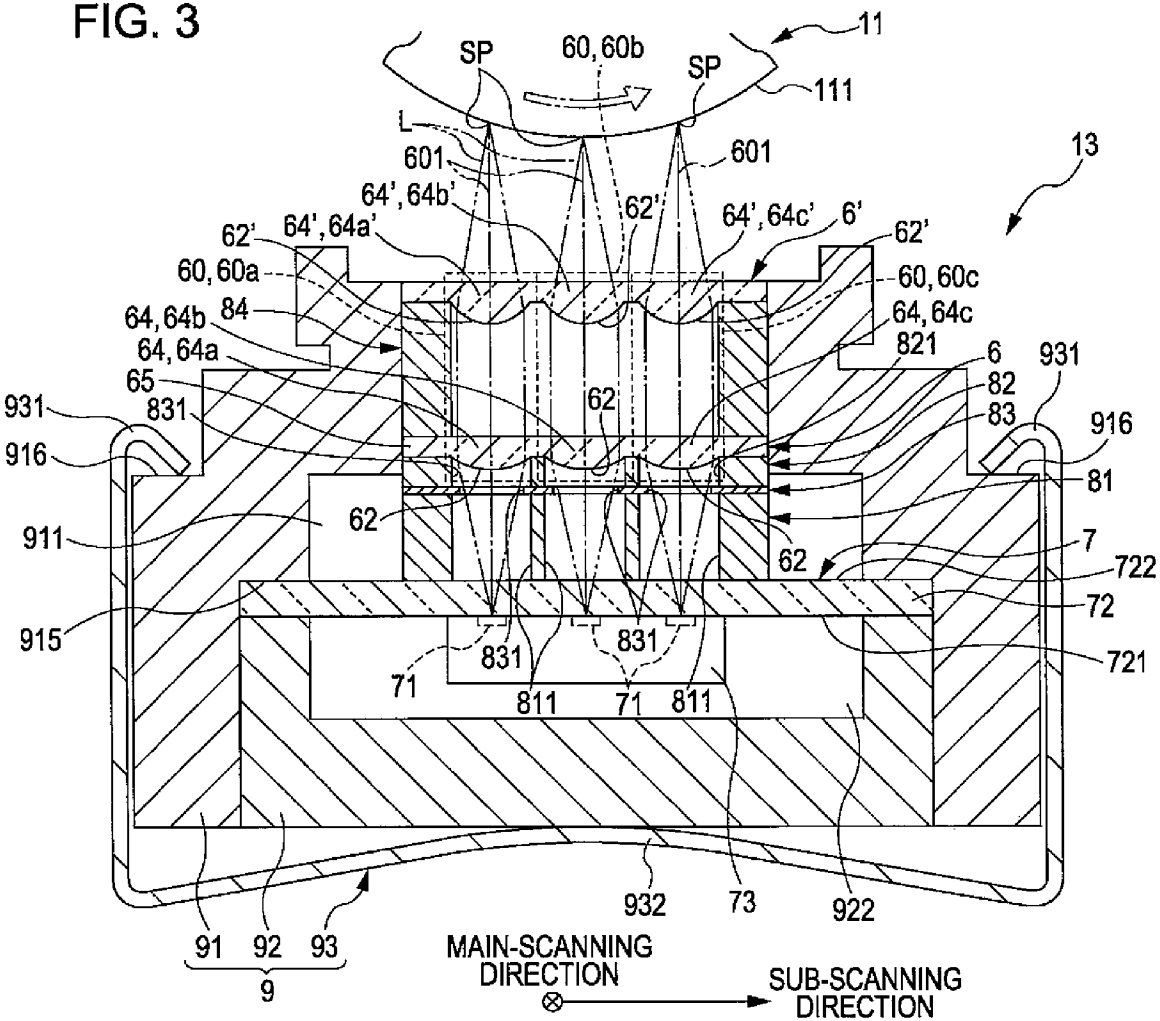
FIG. 3 is a cross-sectional view taken along the line III-III of FIG. 2.
Figure 4:
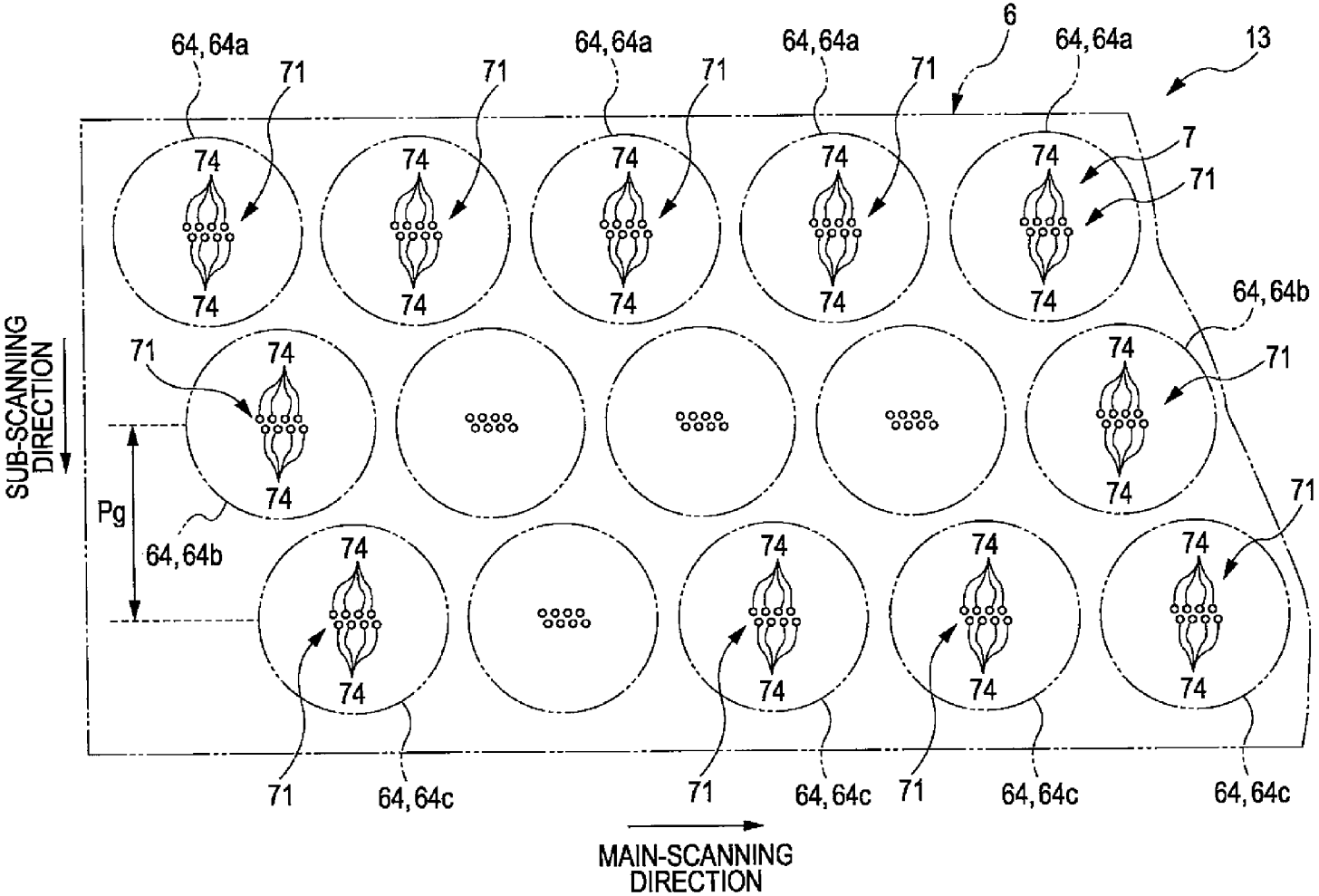
FIG. 4 is a plan view of the line head illustrated in FIG. 2, illustrating the positional relationship between lenses and light-emitting elements.
Figure 5:
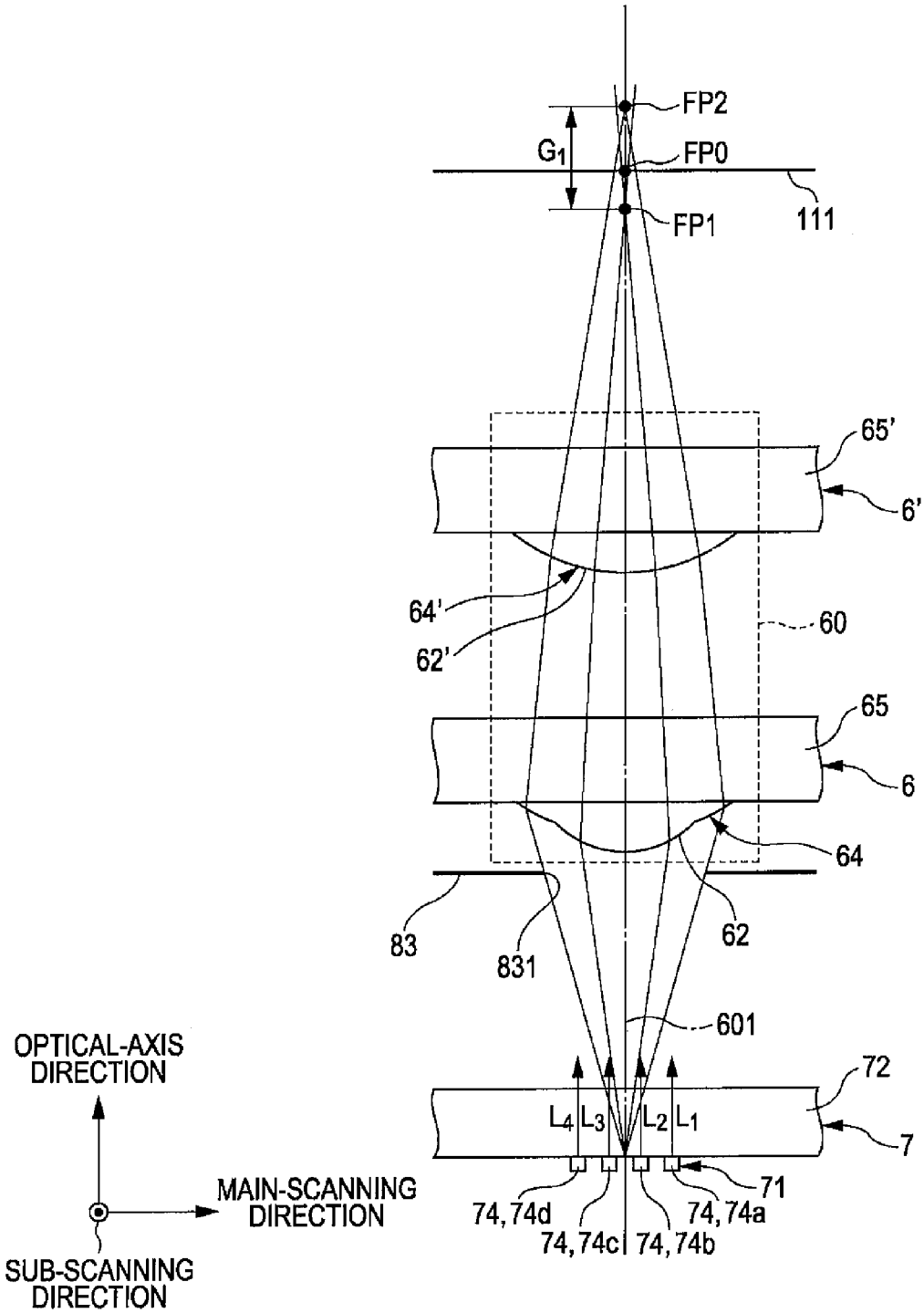
FIG. 5 is a cross-sectional view, taken along the first direction, of an optical system included in the line head illustrated in FIG. 2.
Figure 6A:
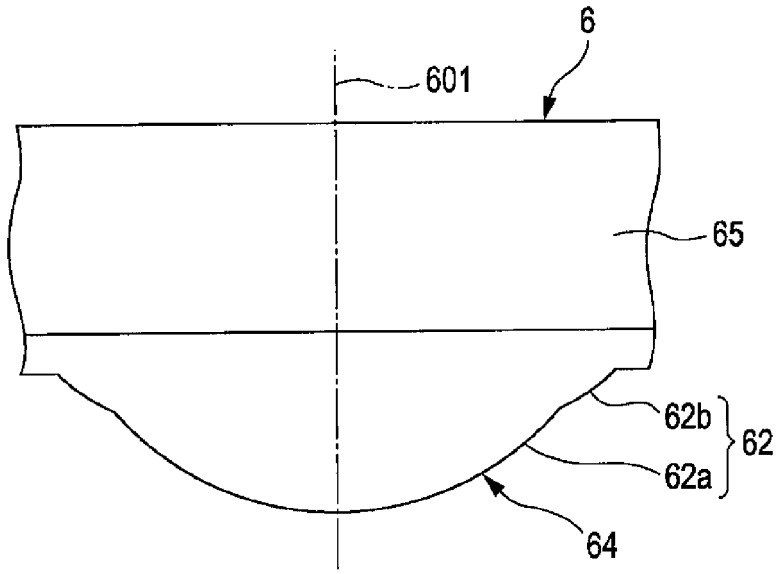
FIGS. 6A and 6B are views illustrating a light-emitting element-side lens included in the optical system illustrated in FIG. 5.
Figure 6B:
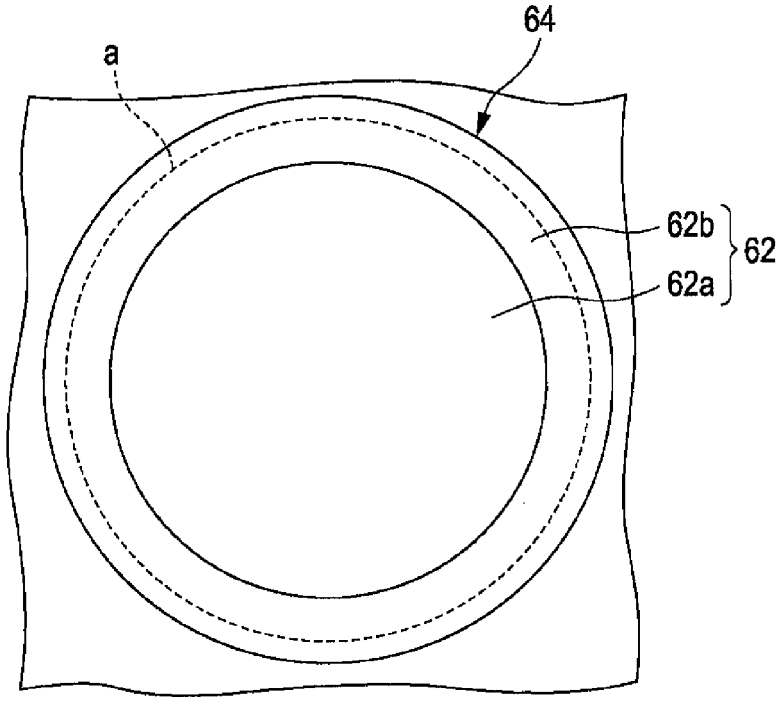
Figure 7:
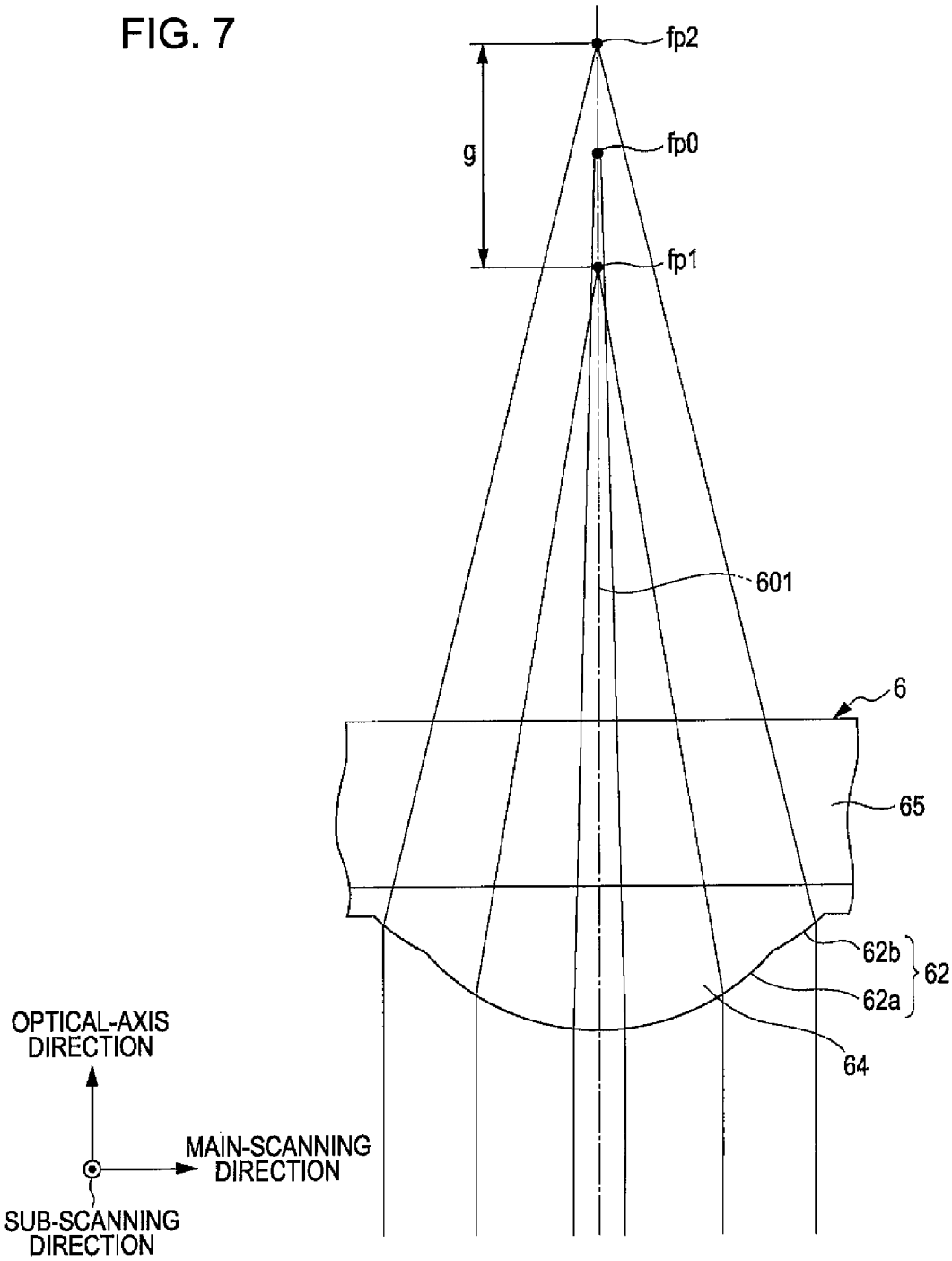
FIG. 7 is a view for describing the operation of the lens illustrated in FIGS. 6A and 6B.
Figure 8:
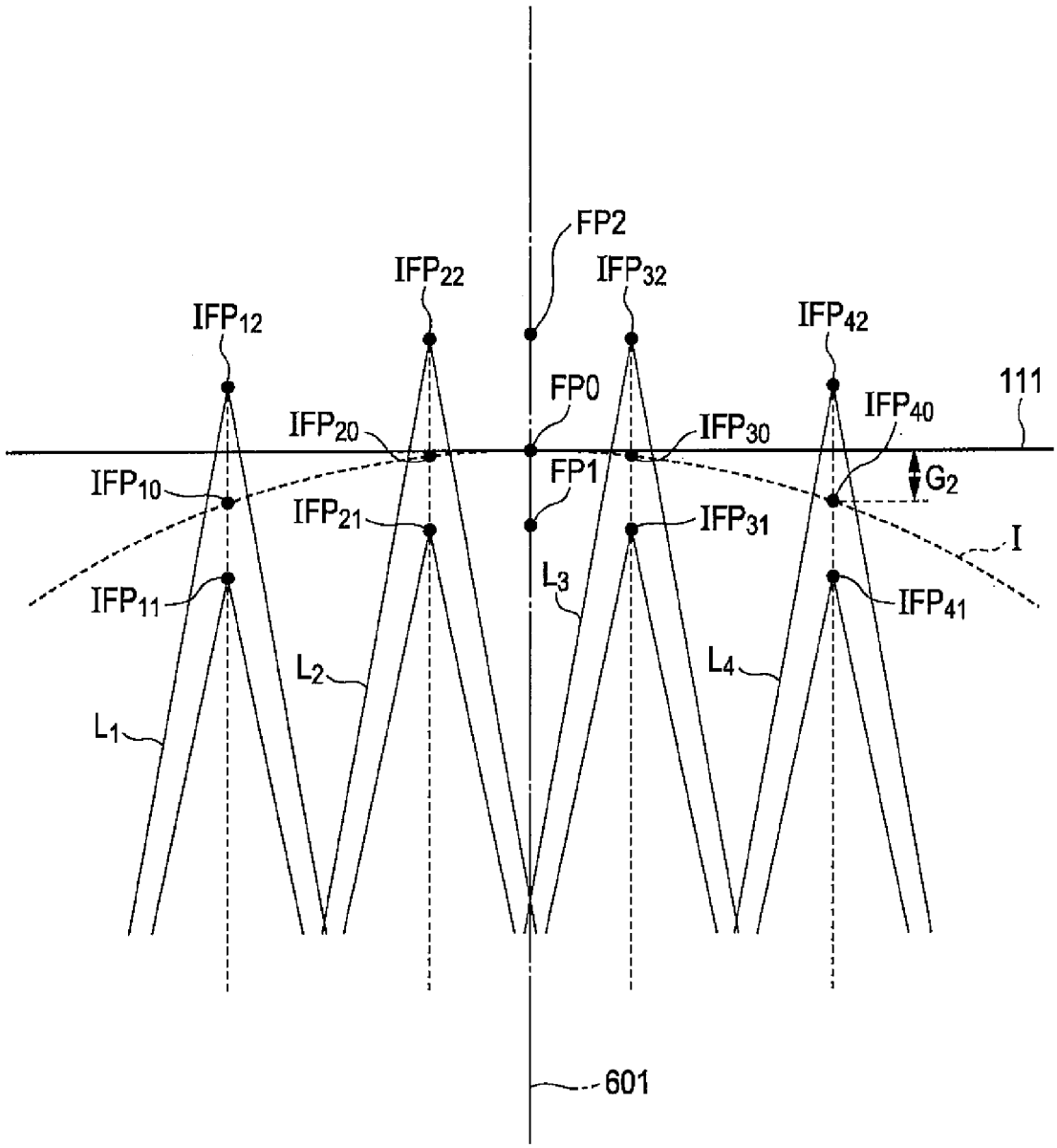
FIG. 8 is a view for describing the operation of the optical system illustrated in FIG. 5.

FIG. 1 is a schematic view illustrating the entire configuration of an image forming apparatus according to an embodiment of the invention. FIG. 2 is a partially sectional perspective view illustrating a line head included in the image forming apparatus illustrated in FIG. 1. FIG. 3 is a cross-sectional view taken along the line III-III of FIG. 2. FIG. 4 is a plan view of the line head illustrated in FIG. 2, illustrating the positional relationship between lenses and light-emitting elements. FIG. 5 is a cross-sectional view, taken along the first direction, of an optical system included in the line head illustrated in FIG. 2. FIGS. 6A and 6B are views illustrating a light-emitting element-side lens included in the optical system illustrated in FIG. 5. FIG. 7 is a view for describing the operation of the lens illustrated in FIGS. 6A and 6B. FIG. 8 is a view for describing the operation of the optical system illustrated in FIG. 5. In the following description, it is assumed that an upper side in FIGS. 1 to 3 and FIG. 5 is "upper" or "upward" and a lower side in the drawings is "lower" or "downward" for convenience of explanation.

Image Forming Apparatus

An image forming apparatus 1 illustrated in FIG. 1 is an electrophotographic printer that records an image on a recording medium P by a series of image forming processes including an electrical charging process, an exposure process, a developing process, a transferring process, and a fixing process. In the present embodiment, the image forming apparatus 1 is a so-called tandem type color printer.

As illustrated in FIG. 1, the image forming apparatus 1 includes: an image forming unit 10 for the electrical charging process, the exposure process, the developing process; a transfer unit 20 for the transferring process; a fixing unit 30 for the fixing process; a transport mechanism 40 for transporting the recording mediums P, such as paper; and a paper feed unit 50 that supplies the recording medium P to the transport mechanism 40.

The image forming unit 10 has four image forming stations: an image forming station 10Y that forms a yellow toner image, an image forming station 10M that forms a magenta toner image, an image forming station 10C that forms a cyan toner image, and an image forming station 10K that forms a black toner image.

Each of the image forming stations 10Y, 10C, 10M, and 10K has a photosensitive drum (photoconductor) 11 which is a latent image carrier that carries an electrostatic latent image thereon. A charging unit 12, a line head (exposure unit) 13, a developing unit 14, and a cleaning unit 15 are provided around the periphery (outer peripheral side) of the photosensitive drum 11 along a rotating direction thereof. The image forming stations 10Y, 10C, 10M, and 10K have substantially the same configurations except that they use toner of different colors.

The photosensitive drum 11 has a cylindrical shape as an overall shape and is configured to be rotatable around an axial line thereof along the direction indicated by the arrow in FIG. 1. A photosensitive layer (not shown) is formed in the vicinity of the outer peripheral surface (cylindrical surface) of the photosensitive drum 11. The outer peripheral surface of the photosensitive drum 11 forms a light receiving surface 111 that receives light L (emitted light) from the line head 13 (refer to FIG. 2).

The charging unit 12 uniformly charges the light receiving surface 111 of the photosensitive drum 11 by corona charging or the like.

The line head 13 receives image information from a host computer (not shown) such as a personal computer and irradiates the light L towards the light receiving surface 111 of the photosensitive drum 11 in response to the image information. When the light L is irradiated to the uniformly charged light receiving surface 111 of the photosensitive drum 11, a latent image (electrostatic latent image) corresponding to an irradiation pattern of the light L is formed on the light receiving surface 111. The configuration of the line head 13 will be described in detail later.

The developing unit 14 has a reservoir (not shown) storing toner therein and supplies toner from the reservoir to the light receiving surface 111 of the photosensitive drum 11 that carries the electrostatic latent image and applies toner thereon. As a result, the latent image on the photosensitive drum 11 is visualized (developed) as a toner image.

The cleaning unit 15 has a cleaning blade 151, which is made of rubber and makes abutting contact with the light receiving surface 111 of the photosensitive drum 11, and is configured to remove toner, which remains on the photosensitive drum 11 after a primary transfer to be described later, by scraping the remaining toner with the cleaning blade 151.

The transfer unit 20 is configured to collectively transfer toner images corresponding to respective colors, which are formed on the photosensitive drums 11 of the image forming stations 10Y, 10M, 10C, and 10K described above, onto the recording medium P.

In each of the image forming stations 10Y, 10C, 10M, and 10K, electrical charging of the light receiving surface 111 of the photosensitive drum 11 performed by the charging unit 12, exposure of the light receiving surface 111 performed by the line head 13, supply of toner to the light receiving surface 111 performed by the developing unit 14, primary transfer to an intermediate transfer belt 21, caused by pressure between the intermediate transfer belt 21 and a primary transfer roller 22, which will be described later, and cleaning of the light receiving surface 111 performed by the cleaning unit 15 are sequentially performed while the photosensitive drum 11 rotates once.

The transfer unit 20 has the intermediate transfer belt 21 having an endless belt shape. The intermediate transfer belt 21 is stretched over the plurality (four in the configuration illustrated in FIG. 1) of primary transfer rollers 22, a driving roller 23, and a driven roller 24. The intermediate transfer belt 21 is driven to rotate in the direction indicated by the arrow illustrated in FIG. 1 and at approximately the same speed as a circumferential speed of the photosensitive drum 11 by rotation of the driving roller 23.

Each primary transfer roller 22 is provided opposite the corresponding photosensitive drum 11 with the intermediate transfer belt 21 interposed therebetween and is configured to transfer (primary transfer) a monochrome toner image on the photosensitive drum 11 to the intermediate transfer belt 21. At the time of primary transfer, a primary transfer voltage (primary transfer bias), which has an opposite polarity to that of electrically charged toner is applied to the primary transfer roller 22.

A toner image corresponding to at least one of the colors yellow, magenta, cyan, and black is carried on the intermediate transfer belt 21. For example, when a full color image is formed, toner images corresponding to the four colors yellow, magenta, cyan, and black are sequentially transferred onto the intermediate transfer belt 21 so as to overlap one another so that a full color toner image is formed as an intermediate transfer image.

In addition, the transfer unit 20 has a secondary transfer roller 25, which is provided opposite the driving roller 23 with the intermediate transfer belt 21 interposed therebetween, and a cleaning unit 26, which is provided opposite the driven roller 24 with the intermediate transfer belt 21 interposed therebetween.

The secondary transfer roller 25 is configured to transfer (secondary transfer) a monochrome or full-color toner image (intermediate transfer image), which is formed on the intermediate transfer belt 21, to the recording medium P such as paper, a film, or cloth, which is supplied from the paper feed unit 50. At the time of secondary transfer, the secondary transfer roller 25 is pressed against the intermediate transfer belt 21, and a secondary transfer voltage (secondary transfer bias) is applied to the secondary transfer roller 25. The driving roller 23 also functions as a backup roller of the secondary transfer roller 25 at the time of this secondary transfer.

The cleaning unit 26 has a cleaning blade 261, which is made of rubber and makes abutting contact with a surface of the intermediate transfer belt 21, and is configured to remove toner, which remains on the intermediate transfer belt 21 after the secondary transfer, by scraping the remaining toner with the cleaning blade 261.

The fixing unit 30 has a fixing roller 301 and a pressure roller 302 pressed against the fixing roller 301 and is configured such that the recording medium P passes between the fixing roller 301 and the pressure roller 302. In addition, the fixing roller 301 is provided with a heater which is provided at the inside thereof so as to heat an outer peripheral surface of the fixing roller 301 so that the recording medium P passing between the fixing roller 301 and the pressure roller 302 can be heated and pressed. By the fixing unit 30 having such a configuration, the recording medium P having a secondary-transferred toner image thereon is heated and pressed, such that the toner image is heat-fixed on the recording medium P as a permanent image.

The transport mechanism 40 has a resist roller pair 41, which transports the recording medium P to a secondary transfer position while calculating the timing of paper feeding to the secondary transfer position between the secondary transfer roller 25 and the intermediate transfer belt 21 described above, and transport roller pairs 42, 43, and 44 which pinch and transport only the recording medium P, on which the fixing process in the fixing unit 30 has been completed.

When an image is formed on only one surface of the recording medium P, the transport mechanism 40 pinches and transports the recording medium P, in which one surface thereof has been subjected to the fixing process by the fixing unit 30, using the transport roller pair 42 and discharges the recording medium P to the outside of the image forming apparatus 1. When images are formed on both surfaces of the recording medium P, the recording medium P in which one surface thereof has been subjected to the fixing process by the fixing unit 30 is first pinched by the transport roller pair 42. Then, the transport roller pair 42 is reversely driven and the transport roller pairs 43 and 44 are driven so as to reverse the recording medium P upside down and transport the recording medium P back to the resist roller pair 41. Then, another image is formed on the other surface of the recording medium P by the same operation as described above.

The paper feed unit 50 is provided with a paper feed cassette 51, which stores therein the recording medium P which has not been used, and a pickup roller 52 that feeds the recording medium P from the paper feed cassette 51 toward the resist roller pair 41 one at a time.

Line Head

Next, the line head 13 will be described in detail. In the following description, the longitudinal direction (first direction) of a long lens array 6 will be referred to as a "main-scanning direction" and the width direction (second direction) of the lens array 6 will be referred to as a "sub-scanning direction" for convenience of explanation.

As illustrated in FIG. 3, the line head 13 is arranged below the photosensitive drum 11 so as to oppose the light receiving surface 111 of the photosensitive drum 11. The line head 13 includes a lens array (first lens array) 6', a spacer 84, the lens array (second lens array) 6, a light shielding member (first light shielding member) 82, a diaphragm member (aperture diaphragm) 83, a light shielding member (second light shielding member) 81, and a light-emitting element array 7, which are sequentially arranged in that order from the side of the photosensitive drum 11 and are accommodated in a casing 9.

In the line head 13, the light L emitted from the light-emitting element array 7 is collimated by the diaphragm member 83 and sequentially passes through the lens array 6' and the lens array 6 to be irradiated onto the light receiving surface 111 of the photosensitive drum 11.

As illustrated in FIG. 2, the lens arrays 6 and 6' are formed of a planar member having a long appearance.

As illustrated in FIG. 3, a plurality of lens surfaces (convex surfaces) 62 is formed on a lower surface (incidence surface) of the lens array 6 on which the light L is incident. On the other hand, an upper surface (emission surface) of the lens array 6 from which the light L is emitted is configured as a flat surface.

That is to say, the lens array 6 includes a plurality of plano-convex lenses 64, each of the lenses having a convex surface on a surface on which the light L is incident and a flat surface on a surface from which the light L is emitted. Here, a portion of the lens array 6 excluding the respective lenses 64 constitutes a support portion 65 that supports each of the lenses 64.

Similarly, on a lower surface (incidence surface) of the lens array 6' on which the light L is incident, a plurality of lens surfaces (convex surfaces) 62' is formed so as to correspond to the plurality of lens surfaces 62 described above. On the other hand, an upper surface (emission surface) of the lens array 6' from which the light L is emitted is configured as a flat surface.

That is to say, the lens array 6' includes a plurality of plano-convex lenses 64', each of the lenses having a convex surface on a surface on which the light L is incident and a flat surface on a surface from which the light L is emitted. Here, a portion of the lens array 6' excluding the respective lenses 64' constitutes a support portion 65' that supports each of the lenses 64'.

A plurality of lens pairs 64 and 64' constitutes an optical system 60 that images light emitted from corresponding light-emitting elements 74 of a light-emitting element group 71 (see FIGS. 5 and 6). The optical system 60 (particularly, the shapes of the lens surfaces of the lenses 64 and 64') will be described in detail later.

The arrangement of the lenses 64 will be described. Since the lenses 64' have the same arrangement (in plan view) as the lenses 64, the description thereof will be omitted.

As illustrated in FIG. 4, the lenses 64 are arranged in plural columns in the main-scanning direction (first direction), and are arranged in plural rows in the sub-scanning direction (second direction) which is orthogonal to the main-scanning direction and the optical axis direction of the lenses 64.

More specifically, the plurality of lenses 64 are arranged in a matrix of three rows by n columns (n is an integer of two or more). In the following description, among the three lenses 64 belonging to one column (lens array), the lens 64 positioned in the middle will be referred to as a "lens 64*b*", the lens 64 positioned at a left side in FIG. 3 (upper side in FIG. 4) will be referred to as a "lens 64*a*", and the lens 64 positioned at a right side in FIG. 3 (lower side in FIG. 4) will be referred to as a "lens 64*c*". In the lenses 64' which are paired with the lenses 64, the lens 64' corresponding to the lens 64*a* will be referred to as a "lens 64*a*'", the lens 64' corresponding to the lens 64*b* will be referred to as a "lens 64*b*'", and the lens 64' corresponding to the lens 64*c* will be referred to as a "lens 64*c*'".

In the present embodiment, the line head 13 is mounted on the image forming apparatus 1 so that, among the plural lenses 64 (64*a* to 64*c*) belonging to one column, the lens 64*b* positioned closest to the center in the sub-scanning direction is arranged at the position closed to the light receiving surface 111 of the photosensitive drum 11. By doing so, the optical characteristics of the plurality of lenses 64 can be configured easily.

As illustrated in FIGS. 2 and 4, in each lens column, the lenses 64*a* to 64*c* are sequentially arranged so as to be offset by an equal distance in the main-scanning direction (right direction in FIG. 4). That is, in each lens column, a line that connects the centers of the lenses 64*a* to 64*c* to one another is inclined at a predetermined angle with respect to the main-scanning direction and the sub-scanning direction.

When seen from the cross section illustrated in FIG. 3, the three lenses 64 belonging to one lens column, namely the lenses 64*a* and 64*c*, are arranged such that the optical axes 601 of the lenses 64*a* and 64*c* are symmetrical with respect to the optical axis 601 of the lens 64*b*. Moreover, the optical axes 601 of the lenses 64*a* to 64*c* are arranged in parallel to each other.

Although the constituent materials of the lens arrays 6 and 6' are not particularly limited as long as they exhibit the optical characteristics described above, the lens arrays 6 and 6' are preferably formed of a resin material and/or a glass material, for example.

As the resin material, various kinds of resin materials can be used. Examples thereof include liquid crystal polymers such as polyamides, thermoplastic polyimides and polyamideimide aromatic polyesters; polyolefins such as polyphenylene oxide, polyphenylene sulfide and polyethylene; polyesters such as modified polyolefins, polycarbonate, acrylic (methacrylic) resins, polymethyl methacrylate, polyethylene terephthalate and polybutylene terephthalate; thermoplastic resins such as polyethers, polyether ether ketones, polyetherimide and polyacetal; thermosetting resins such as epoxy resins, phenolic resins, urea resins, melamine resins, unsaturated polyester resins and polyimide resins; photocurable resins; and the like. These can be used individually or in combination of two or more species.

Among these resin materials, resin materials such as thermosetting resins and photocurable resins are preferred because such materials have a relative low thermal expansion coefficient and are rarely thermally expanded (deformed), modified or deteriorated, in addition to the advantages of a relative high refractive index.

In addition, as the glass material, various kinds of glass materials, such as soda glass, crystalline glass, quartz glass, lead glass, potassium glass, borosilicate glass, alkali-free glass, and the like may be mentioned. When a later-described supporting plate 72 of the light-emitting element array 7 is formed of a glass material, the lens arrays 6 and 6' are preferably formed of a glass material having approximately the same linear expansion rate as the above glass material. By doing so, the positional misalignment of the respective lenses relative to the light-emitting elements due to temperature variation can be prevented.

When the lens array 6 is formed by using a combination of the described resin material and glass material, a glass substrate formed of a glass material may be used as the support portion 65, for example, as will be described later. In this case, a resin layer formed of a resin material may be formed on one surface of the glass substrate, and the lens surface 62 may be formed on the other surface of the glass substrate opposite the resin layer, thus forming the lens 64 (see FIGS. 5 and 6). In addition, the lens array 6 may be obtained, for example, by forming a plurality of convex portions, which is formed of a resin material and protrudes in a convex surface shape, on one surface of a flat plate-like member (substrate) which is formed of a glass material.

As illustrated in FIGS. 2 and 3, a spacer 84 is provided between the lens arrays 6 and 6'. The lens arrays 6 and 6' are bonded together via the spacer 84.

The spacer 84 has a function of regulating a gap length that is a distance between the lens arrays 6 and 6'.

The spacer 84 has a frame shape which corresponds to the outer peripheral portions of the lens arrays 6 and 6' and is bonded to these peripheral portions. The spacer 84 is not limited to being a frame-shaped member as long as it has the above-described function. The spacer 84 may be configured as a pair of members which correspond to one of the opposing sides of the outer peripheral portions of the lens arrays 6 and 6'. Alternatively, the spacer 84 may be configured as a planar member having through-holes formed therein so as to correspond to optical paths, similar to light shielding members 81 and 82 which will be described later.

Although the constituent materials of the spacer 84 are not particularly limited as long as they exhibit the above-described function, a resin material, a metallic material, a glass material, a ceramics material, and the like can be used, for example.

As illustrated in FIG. 3, at a side of the lens array 6 on which the light L is incident, the light-emitting element array 7 is provided with the light shielding member 82, a diaphragm member 83, and the light shielding member 81 interposed therebetween. The light-emitting element array 7 has a plurality of groups of light-emitting elements (light-emitting element groups) 71 and a supporting plate (head substrate) 72.

The supporting plate 72 is configured to support each of the light-emitting element groups 71 and is formed of a planar member having a long appearance. The supporting plate 72 is arranged in parallel to the lens array 6.

In addition, the length of the supporting plate 72 in the main-scanning direction is larger than that of the lens array 6 in the main-scanning direction. The length of the supporting plate 72 in the sub-scanning direction is also set to be larger than that of the lens array 6 in the sub-scanning direction.

Although the constituent materials of the supporting plate 72 are not particularly limited, when the light-emitting element groups 71 are provided on the bottom surface side of the supporting plate 72 (that is, bottom emission-type light-emitting elements are used as the light-emitting elements 74), the supporting plate 72 is preferably formed of transparent materials such as various kinds of glass materials or various kinds of plastics. When top emission-type light-emitting elements are used as the light-emitting elements 74, the constituent materials of the supporting plate 72 are not limited to the transparent materials, various kinds of metallic materials, such as aluminum or stainless steel, various kinds of glass materials, various kinds of plastics, and the like may be used individually or in combination thereof. When the supporting plate 72 is formed of various kinds of metallic materials or various kinds of glass materials, heat generated by the emission of the light-emitting elements 74 can be efficiently dissipated through the supporting plate 72. When the supporting plate 72 is formed of various kinds of plastics, the weight of the supporting plate 72 can be reduced.

A box-shaped accommodation portion 73 which is open to the supporting plate 72 is provided on the bottom surface side of the supporting plate 72. The plurality of light-emitting element groups 71, wiring lines (not shown) electrically connected to the light-emitting element groups 71 (the respective light-emitting elements 74), or circuits (not shown) used for driving the respective light-emitting elements 74 are accommodated in the accommodation portion 73.

The plurality of light-emitting element groups 71 are separated from each other and arranged in a matrix of three rows by n columns (n is an integer of two or more) so as to correspond to the plurality of lenses 64 described above (for example, see FIG. 4). Each of the light-emitting element groups 71 is configured to include a plurality (8 in the present embodiment) of light-emitting elements 74.

The eight light-emitting elements 74 that constitute each of the light-emitting element groups 71 are arranged along a lower surface 721 of the supporting plate 72 illustrated in FIG. 3. The light L emitted from each of the eight light-emitting elements 74 is focused (imaged) on the light receiving surface 111 of the photosensitive drum 11 through the corresponding lens 64.

In addition, as illustrated in FIG. 4, the eight light-emitting elements 74 are separated from each other and are arranged in four columns in the main-scanning direction and in two rows in the sub-scanning direction. Thus, the eight light-emitting elements 74 are arranged in a matrix of two rows by four columns. The two adjacent light-emitting elements 74 belonging to one column (column of light-emitting elements) are arranged so as to be offset from each other in the main-scanning direction.

In the eight light-emitting elements 74 which form a matrix of two rows by four columns, two light-emitting elements 74 which are adjacent to each other in the main-scanning direction are supplemented by one light-emitting element 74 in the next row.

There is a limitation in arranging the eight light-emitting elements 74 as closely as possible in one row, for example. However, it is possible to increase further the arrangement density of the light-emitting elements 74 by arranging the eight light-emitting elements 74 so as to be offset from each other as described above. In this way, the recording density of the recording medium P when an image is recorded on the recording medium P can be increased further. As a result, it is possible to obtain the recording medium P carrying thereon an image which has high resolution and multiple gray-scale levels and is clear.

In addition, although the eight light-emitting elements 74 belonging to one light-emitting element group 71 are arranged in a matrix of two rows by four columns in the present embodiment, the arrangement shape is not limited thereto. For example, the eight light-emitting elements 74 may be arranged in a matrix of four rows by two columns.

As described above, the plurality of light-emitting element groups 71 are arranged in a matrix of three rows by n columns so as to be separated from each other. As illustrated in FIG. 4, the three light-emitting element groups 71 belonging to one column (column of light-emitting element groups) are arranged so as to be offset from each other by an equal distance in the main-scanning direction (right direction in FIG. 4).

Thus, in the light-emitting element groups 71 which form a matrix of three rows by n columns, the gaps between adjacent light-emitting element groups 71 are sequentially supplemented by the light-emitting element group 71 of the next row and the light-emitting element group 71 of the subsequent row.

There is a limitation in arranging the plurality of light-emitting element groups 71 as closely as possible in one row, for example. However, it is possible to increase further the arrangement density of the light-emitting element groups 71 by arranging the plurality of light-emitting element groups 71 so as to be offset from each other as described above. In this way, due to the synergetic effect, along with the fact that the eight light-emitting elements 74 within one light-emitting element group 71 are arranged so as to be offset from each other, the recording density of the recording medium P when an image is recorded on the recording medium P can be increased further. As a result, it is possible to obtain a recording medium P carrying thereon an image which has higher resolution, multiple gray-scale levels, and high color reproducibility and is clearer.

The light-emitting elements 74 are bottom emission-type organic electroluminescence (EL) element. The light-emitting elements 74 are not limited to the bottom emission-type elements and may be top emission-type elements. In this case, the supporting plate 72 is not required to have optically transparent properties as described above.

When the light-emitting elements 74 are organic EL elements, the gaps (pitches) between the light-emitting elements 74 can be set to be relatively small. In this way, the recording density of the recording medium P when an image is recorded on the recording medium P can be made relatively high. In addition, the light-emitting elements 74 can be formed with highly accurate sizes and at highly accurate positions by using various film-forming methods. As a result, it is possible to obtain the recording medium P carrying thereon a clearer image.

In the present embodiment, all of the light-emitting elements 74 are configured to emit red light. Here, as examples of the constituent materials of a light-emitting layer which emits red light, (4-dicyanomethylene)-2-methyl-6-paradimethylaminostyryl)-4H-pyrane (DCM), Nile Red and the like can be mentioned. In addition, the light-emitting elements 74 are not limited to those configured to emit red light, but may be configured to emit monochromatic light of another color or white light. Thus, in the organic EL element, the light L emitted from the light-emitting layer can be appropriately set to monochromatic light of an arbitrary color in accordance with the constituent materials of the light-emitting layer.

Since the spectral sensitivity characteristic of the photosensitive drum used in the electrophotographic process is generally set to have a peak in a wavelength range of a red wavelength, which is the emission wavelength of a semiconductor laser, to a near-red wavelength, it is preferable to use the materials capable of emitting red light as described above.

As illustrated in FIG. 3, the light shielding member 82, the diaphragm member 83, and the light shielding member 81 are provided between the lens array 6 and the light-emitting element array 7.

The light shielding members 81 and 82 are configured to prevent crosstalk of the light L between the adjacent light-emitting element groups 71.

A plurality of through-holes (openings) 811 is formed in the light shielding member 81 so as to pass through the light shielding member 81 in the up and down direction (thickness direction) of FIG. 3. These through-holes 811 are arranged at positions corresponding to the respective lenses 64.

Similarly, a plurality of through-holes 821 is formed in the light shielding member 82 so as to pass through the light shielding member 82 in the up and down direction (thickness direction) of FIG. 3. These through-holes 821 are arranged at positions corresponding to the respective lenses 64.

Each of the through-holes 811 and 821 is configured to form an optical path which extends from the light-emitting element group 71 to the corresponding lens 64. In addition, each of the through-holes 811 and 821 has a circular shape in plan view thereof and includes therein the eight light-emitting elements 74 of the light-emitting element group 71 corresponding to each of the through-holes 811 and 821.

Although the through-holes 811 and 821 have a cylindrical shape in the configuration illustrated in FIG. 3, the invention is not limited thereto. For example, the through-holes 811 and 821 may have a circular truncated cone shape which expands upward.

The diaphragm member 83 is provided between the light shielding members 81 and 82.

The diaphragm member 83 is an aperture diaphragm that restricts the amount of light L incident on the lens 64 from the light-emitting element group 71 to a predetermined amount. That is to say, the diaphragm member 83 regulates the outer diameter of the light L emitted from the light-emitting element 74.

The diaphragm member 83 has a planar or layered shape, and a plurality of through-holes (openings) 831 is formed in the diaphragm member 83 so as to pass through the diaphragm member 83 in the up and down direction (thickness dimension) of FIG. 3. These through-holes 831 are arranged at positions corresponding to the lenses 64 (namely, the above-described through-holes 811 and 821).

In addition, each of the through-holes 831 of the diaphragm member 83 has a circular shape in plan view thereof and has a diameter smaller than that of the through-holes 811 of the light shielding member 81 described above.

The diaphragm member 83 is preferably configured to set the distance to the lens 64 so as to be relatively small. By doing so, light emitted from light-emitting elements 74 which are located at different distances from the optical axis 601 (that is, even when the light-emitting elements 74 are located at different angles of view) can be made incident to approximately the same region of the lens 64.

The diaphragm member 83 is provided between the optical system 60, which will be described later, and the light-emitting element group 71. Therefore, even when light is emitted from light-emitting elements 74 having different angles of view, the light can be made incident to a desired region of the lens 64 of the optical system 60, which will be described later.

The light shielding members 81 and 82 and the diaphragm member 83 also have a function of regulating the distance, positional relationship, and attitude between the lens array 6 and the supporting plate 72 with high accuracy.

The distance between the lens surface 62 of each lens 64 and the corresponding light-emitting element group 71 is an important condition (element) that determines the position in the up and down direction of FIG. 3 of the imaging position of the optical system 60 which will be described later. Therefore, as described above, when the light shielding members 81 and 82 and the diaphragm member 83 function as the spacer that regulates the gap length which is the distance between the lens array 6 and the light-emitting element array 7, it is possible to obtain the image forming apparatus 1 which is highly precise and reliable.

Moreover, the light shielding member 81 and 82 and the diaphragm member 83 preferably have at least an inner peripheral surface thereof which has a dark color such as black, brown, or dark blue.

Although the constituent materials of the light shielding members 81 and 82 and the diaphragm member 83 are not particularly limited as long as they are not optically transparent, various kinds of coloring agents, metallic materials such as chrome or chromic oxides, resins having mixed therein carbon black or coloring agents, and the like can be mentioned as examples thereof.

As illustrated in FIGS. 2 and 3, the lens array 6, the light-emitting element array 7, the spacer 84, the light shielding members 81 and 82, and the diaphragm member 83 are collectively accommodated in the casing 9. The casing 9 has a frame member (casing body) 91, a lid member (bottom lid) 92, and a plurality of clamp members 93 which fixedly secures the frame member 91 to the lid member 92 (see FIG. 3).

The frame member 91 has a generally long shape, as illustrated in FIGS. 2, 5, and 6.

In addition, the frame member 91 has a frame shape, and an inner cavity portion 911 that is open to the upper and lower sides of the frame member 91 is formed in the frame member 91 as illustrated in FIG. 3. The width of the inner cavity portion 911 gradually decreases upwardly from the lower side of FIG. 3.

The lens array 6', the spacer 84, the lens array 6, the light shielding member 82, the diaphragm member 83, the light shielding member 81, and the light-emitting element array 7 are inserted in the inner cavity portion 911, and they are fixed by adhesive, for example. In this way, the lens array 6', the spacer 84, the lens array 6, the light shielding member 82, the diaphragm member 83, the light shielding member 81, and the light-emitting element array 7 are collectively held on the frame member 91, such that the positions in the main and sub-scanning directions of the lens array 6', the spacer 84, the lens array 6, the light shielding member 82, the diaphragm member 83, the light shielding member 81, and the light-emitting element array 7 are determined.

Here, an upper surface 722 of the supporting plate 72 of the light-emitting element array 7 is in contact (abutting contact) with a stepped portion 915, which is formed on a wall surface of the inner cavity portion 911, and the lower surface of the second light shielding member 81. The lid member 92 is inserted into the inner cavity portion 911 from the lower side.

The lid member 92 is formed of a lengthy member having a recess portion 922 in which the accommodation portion 73 is inserted at an upper side thereof. The edge portions of the supporting plate 72 of the light-emitting element array 7 are pinched between the upper end surface of the lid member 92 and the boundary portion 915 of the frame member 91.

Moreover, the lid member 92 is pressed upward by each of the clamp members 93. In this way, the lid member 92 is fixed to the frame member 91. In addition, by the pressed lid member 92, the positional relationships among the light-emitting element array 7, the light shielding members 81 and 82, the diaphragm member 83, and the lens array 6 in the main-scanning direction, the sub-scanning direction, and the up and down direction of FIG. 3 are fixed.

The clamp members 93 are preferably arranged in plural numbers at equal intervals in the main-scanning direction. Accordingly, the frame member 91 and the lid member 92 can be pinched uniformly in the main-scanning direction.

The clamp member 93 is approximately U shaped in the cross section illustrated in FIG. 3 and is formed by folding a metallic plate. Both ends of the clamp member 93 are bent inward to form claw portions 931. The claw portions 931 are engaged with shoulder portions 916 of the frame member 91.

In addition, a curved portion 932 which is curved upward in an arch shape is formed in the middle portion of the clamp member 93. The apex of the curved portion 932 is in pressure-contact with the lower surface of the lid member 92 in a state where the claw portions 931 are engaged with the shoulder portion 916. In this way, the curved portion 932 urges the lid member 92 upwardly in a state where the curved portion 932 is elastically deformed.

In addition, when the clamp members 93 which pinch the frame member 91 and the lid member 92 are detached, the lid member 92 can be detached from the frame member 91. Then, it is possible to perform maintenance, such as replacement and repair, for the light-emitting element array 7.

Furthermore, the constituent materials of the frame member 91 and the lid member 92 are not particularly limited, and the same constituent materials as the supporting plate 72 may be used, for example. The constituent materials of the clamp member 93 are not particularly limited, and aluminum or stainless steel may be used, for example. In addition, the clamp member 93 may also be formed of a hard resin material.

Moreover, although not illustrated in the drawings, the frame member 91 has spacers which are provided at both ends in the longitudinal direction thereof so as to protrude upward. The spacers are configured to regulate the distance between the light receiving surface 111 and the lens array 6.

Optical System

Next, the optical system 60 of the line head 13 will be described in detail with reference to FIGS. 5 to 8.

As described above, in the line head 13, a pair of lenses 64 and 64' corresponding to the light-emitting element group 71 are arranged in the optical axis direction. As illustrated in FIG. 5, this pair of lenses 64 and 64' constitutes the optical system 60 that images the light emitted from the light-emitting elements 74 belonging to the corresponding light-emitting element group 71 on an image surface I.

FIG. 5 illustrates a view of the optical system 60 taken along a cross section (hereinafter referred to as a "main-cross section") which is parallel to the optical axis direction (second direction) and the main-scanning direction (first direction). In the following description, if necessary, the optical system 60 formed by a pair of lenses 64*a* and 64*a*' will be referred to as an "optical system 60*a*", the optical system 60 formed by a pair of lenses 64*b* and 64*b*' will be referred to as an "optical system 60*b*", and the optical system 60 formed by a pair of lenses 64*c* and 64*c*' will be referred to as an "optical system 60*c*".

The optical system 60 is configured to image the light L having passed through the through-holes (aperture diaphragm) 831 of the diaphragm member 83 in the vicinity of the light receiving surface 111 of the photoconductor 11. In the present embodiment, the optical system 60 is arranged to be telecentric on the image side.

Here, the optical system 60 has an axis of symmetry when seen on a cross section (main-cross section) which contains the optical axis 601 and is taken along the main-scanning direction (first direction). In the present embodiment, the axis of symmetry of the optical system 60 is identical to the optical axis 601. Due to this configuration, the imaging characteristics of the optical system 60 which will be described later can be realized relatively easily and reliably.

The optical system 60 may not have the axis of symmetry as described above, and the axis of symmetry may not be identical to the optical axis 601. Furthermore, although the optical system 60 may not be rotationally symmetrical to the optical axis 601, in the following description, the optical system 60 will be described as being rotationally symmetrical to the optical axis 601, for convenience of explanation.

The optical system 60 is configured so as to have an imaging point FP0 which is located in the vicinity of the axis of symmetry of the optical system 60, an imaging point FP1 which is located offset toward the side of the optical system 60 with respect to the imaging point FP0, and an imaging point FP2 which is located offset toward the opposite side.

That is to say, in the optical system 60, when light is incident from the light-emitting element 74, the light is imaged at different positions (imaging points FP0, FP1, and FP2) depending on the portion of the optical system 60 through which the light passes. In other words, the optical system 60 has a plurality of imaging points FP0, FP1, and FP2 which are formed at different positions in the optical axis direction (that is to say, the optical system 60 has a longitudinal aberration).

Here, the imaging point FP0 is a position (paraxial imaging point) at which, when the ray of light emitted from a virtual light-emitting element located on the optical axis 601 is incident in the vicinity of the optical axis 601 of the optical system 60, the emitted ray of light intersects the optical axis 601. The imaging point FP1 is the position closest to the optical system 60 among the positions at which, when the off-axis ray of light emitted from the virtual light-emitting element located on the optical axis 601 is incident to the optical system 60 via the diaphragm member 83, the emitted ray of light intersects the optical axis 601. The imaging point FP2 is the position farthest from the optical system 60 among the positions at which, when the off-axis ray of light emitted from the virtual light-emitting element located on the optical axis 601 is incident to the optical system 60 via the diaphragm member 83, the emitted ray of light intersects the optical axis 601.

That is to say, the optical system 60 has a longitudinal aberration on the side of the optical system 60 and the opposite side with respect to the imaging point FP0. Here, the difference between the maximum value and the minimum value of the longitudinal aberration corresponds to the distance G1 between the imaging point FP1 and the imaging point FP2.

In the optical system 60, the spot size of the light L from the light-emitting element 74 can be made to be small and substantially constant for the ray of light imaged at a imaging point located between the imaging point FP1 and the imaging point FP2 which are respectively located furthest from and closest to the optical system 60, among the plurality of imaging points FP0, FP1, and FP2. In particular, by making sure that the optical system 60 has the imaging point FP0 in the vicinity of the optical axis 601 so as to be located between the imaging point FP1 and the imaging point FP2, it is possible to increase the distance G1 between the imaging point FP1 and the imaging point FP2 (namely, the difference between the maximum value and the minimum value of the longitudinal aberration) while satisfying other optical characteristics needed by the optical system 60. As a result, when the light emitted from the light-emitting elements 74 is imaged by the optical system 60, it is possible to make the spot size substantially constant over a relatively wide range in the optical axis direction in the vicinity of the image surface.

Therefore, even when the positional relationship in the optical axis direction (second direction) between the image surface and the light receiving surface 111, which is the light irradiation surface, is changed or offset, it is possible to prevent a variation of the spot size on the light receiving surface 111. As a result, it is possible to prevent concentration unevenness in the formed latent images.

Furthermore, the optical system 60 is preferably configured such that the distance G1 in the optical axis direction between the imaging point FP2 and the imaging point FP1, which are respectively located furthest from and closest to the optical system 60 (namely, the difference between the maximum value and the minimum value of the longitudinal aberration), is larger than the minimum spot diameter (minimum spot size) of the light emitted from the light-emitting element 74 (namely, the light converging in the optical system 60). By doing so, it is possible to effectively prevent the above-described variation of the spot size on the light receiving surface 111.

The optical system 60 having such characteristics can be realized by a multifocal lens having different focal points.

In the present embodiment, the lenses 64 are configured as multifocal lenses having a plurality of focal points, and the lenses 64' are configured as single focus lenses having a single focal point so that the optical system 60 is configured to have the plurality of above-described imaging points FP0, FP1, and FP2.

As illustrated in FIG. 6A, the lens 64 is formed on the support portion 65 which is formed of a glass material, for example. As illustrated in FIG. 6B, the lens 64 has a lens surface 62 on an opposite side to the support portion 65.

The lens surface 62 of the lens 64 has a rotationally symmetrical shape and is formed so that the lens 64 has a plurality of focal points fp0, fp1, and fp2 which are located at different positions in the optical axis direction, as illustrated in FIG. 7.

Here, the focal point fp0 is a position (paraxial focal point) at which, when light parallel to the optical axis 601 is incident in the vicinity of the optical axis 601 of the lens 64, the ray of the light (the emitted light) intersects the optical axis 601. The focal point fp1 is the position closest to the lens 64 among the positions at which, when light parallel to the optical axis 601 is incident to the lens 64 via the diaphragm member 83, the ray of the light (the emitted light) intersects the optical axis 601. The focal point fp2 is the position farthest from the lens 64 among the positions at which, when light parallel to the optical axis 601 is incident to the lens 64 via the diaphragm member 83, the ray of the light (the emitted light) intersects the optical axis 601.

That is to say, the lens 64 has a longitudinal aberration on the side of the lens 64 and the opposite side with respect to the focal point fp0. The difference between the maximum value and the minimum value of the longitudinal aberration corresponds to the distance g between the focal points fp1 and fp2.

By providing the lens 64, which is a multifocal lens, in the vicinity of the aperture diaphragm (the diaphragm member 83), it is possible to obtain an advantage of increasing a defocus region where a change in the spot size is similarly small for both the light-emitting element 74 which is located in the vicinity of the optical axis 601 and the light-emitting element 74 which is located off the optical axis 601.

More specifically, as illustrated in FIGS. 6A and 6B, the lens surface 62 of the lens 64 has a first circular region 62*a* which is defined at a central portion thereof and a second ring-shaped region 62*b* which is defined at a position so as to surround the periphery of the first region 62*a*. In FIG. 6, a region, through which the light having passed through the diaphragm member (aperture diaphragm) 83 passes, is indicated by broken lines.

The surface shape of the first region 62*a* and the surface shape of the second region 62*b* are defined by different definition formulas. As the definition formula, a definition formula (rotationally symmetrical aspheric surface) expressed by Formula 1 below can be used, for example (see Examples below for more details). In this way, the lens 64 having the above-described characteristics can be realized relatively easily and reliably.

$$Z = \frac{cr^2}{1 + \sqrt{1 - (1 - K)c^2r^2}} + Ar^4 + Br^6 + Cr^8 + \Delta \quad \text{(Formula 1)}$$

In the definition formula expressed by Formula 1 above, z: coordinate in optical axis direction (second direction)

r: distance from optical axis c: curvature on optical axis

K: conic coefficient

A to C, Δ: aspheric coefficient

The respective coefficients A to C and Δ of the definition formula are appropriately set in accordance with the focal distance of the optical system 60, the shape of the lens surface 62' of the lens 64', and the like so that the optical system 60 has a plurality of above-described imaging points.

When at least one of the coefficients A to C and Δ of the definition formula is changed, the first region 62*a* and the second region 62*b* will be expressed by different definition formulas.

The optical axis in the definition formula refers to the axis of symmetry of a rotationally symmetrical lens.

The size of the first region 62*a* is larger than the size of the second region 62*b*. By doing so, the size of the first region 62*a* within the light passing region a can be made to be substantially the same as the size of the second region 62*b* within the light passing region a. As a result, even when the positions in the optical axis direction of the image surface and the light receiving surface 111 are changed, light amount unevenness (concentration unevenness) of the spots formed on the light receiving surface 111 can be suppressed.

In particular, as described above, the optical system 60 has a plurality (two) of lenses 64 and 64' which are arranged in the optical axis direction thereof. Moreover, the lens 64 which is located closest to the side of the light-emitting elements 74 has the above-described lens surface 62 having the first region 62*a* and the second region 62*b*. Therefore, the optical system 60 can reliably exhibit the above-described characteristics even when the light-emitting elements 74 are located at different distances from the optical axis 601 (namely, even when the angles of view are different).

Moreover, since the lens surface 62 including the first region 62*a* and the second region 62*b* is provided on the side of the lens 64 close to the light-emitting elements 74, it is possible to suppress characteristic variation due to an angle of view.

Similar to the lens 64, the lens 64' is formed on a support portion 65' which is formed of a glass material, for example. The lens 64' has a lens surface 62' on an opposite side to the support portion 65'.

The lens surface 62' of the lens 64' may be a spherical surface or an aspheric surface, and a surface shape thereof can be defined by one definition formula. As the definition formula, a definition formula (xy polynomial surface) expressed by Formula 2 below can be used, for example (see Examples below for more details).

$$Z = \frac{cr^2}{1+\sqrt{1-(1+K)c^2r^2}} + Ax^2 + By^2 + Cx^4 + Dx^2y^2 + Ey^4 + Fx^6 + Gx^4y^2 + Hx^2y^4 + Iy^6 \quad \text{(Formula 2)}$$

In the definition formula expressed by Formula 2 above, $r^2=x^2+y^2$, and x: coordinate in main-scanning direction (first direction)
y: coordinate in sub-scanning direction
z: sag amount on plane parallel to optical axis
c: curvature on optical axis
K: conic coefficient
A to I: aspheric coefficient The respective coefficients A to I of the definition formula are appropriately set in accordance with the focal distance of the optical system 60, the shape of the lens surface 62 of the lens 64, and the like so that the optical system 60 has a plurality of above-described imaging points.

In the optical system 60 having the above-described configuration, the light L (L1, L2, L3, and L4) emitted from the four light-emitting elements 74 (74*a*, 74*b*, 74*c*, and 74*d*), which are linearly arranged in the main-scanning direction as illustrated in FIGS. 5 and 6, are sequentially permitted to pass through the lens 64 and the lens 64' after passing through the diaphragm member 83. In this way, the respective light L1, L2, L3, and L4 are imaged (focused) in the vicinity of the light receiving surface 111 of the photoconductor 11 as illustrated in FIG. 8.

At that time, by the above-described function of the optical system 60 having a plurality of imaging points, the light L1 is imaged at a plurality of imaging positions IFP10, IFP11, and IFP12 which are located at different positions in its travelling direction (second direction).

Here, the imaging position IFP10 is a position (paraxial imaging point) at which, when the light L1 emitted from the light-emitting element 74*a* is incident to the lens 64 via the diaphragm member 83, the ray of light passing through the vicinity of the optical axis 601 is imaged (focused). The imaging position IFP11 is the position closest to the optical system 60 among the positions at which, when the light L1 emitted from the light-emitting element 74*a* is incident, to the lens 64 via the diaphragm member 83, the ray of light passing through the first region 62*a* of the lens 64 is imaged (focused). The imaging position IFP12 is the position furthest from the optical system 60 among the positions at which, when the light L1 emitted from the light-emitting element 74*a* is incident to the lens 64 via the diaphragm member 83, the ray of light passing through the second region 62*b* of the lens 64 is imaged (focused).

Similarly, the light L2 is imaged at a plurality of imaging positions IFP20, IFP21, and IFP22 which are located at different positions in its travelling direction (second direction). Moreover, the light L3 is imaged at a plurality of imaging positions IFP30, IFP31, and IFP32 which are located at different positions in its travelling direction (second direction). Furthermore, the light L4 is imaged at a plurality of imaging positions IFP40, IFP41, and IFP42 which are located at different positions in its travelling direction (second direction).

The respective light L1, L2, L3, and L4 imaged by the optical system 60 will have their spot sizes which are, substantially constant over a relatively wide range (distance G1) in the optical axis direction in the vicinity of the image surface.

The optical system 60 is configured so that the respective imaging positions IFP10, IFP20, IFP30, and IFP40 are located in the vicinity of the light receiving surface 111.

Therefore, even when the positional relationship in the optical axis direction (second direction) between the image surface I and the light receiving surface 111, which is the light irradiation surface, is changed or offset, the light receiving surface 111 is positioned between the imaging positions IFP11 and IFP12, between the imaging positions IFP21 and IFP22, between the imaging positions IFP31 and IFP32, and between the imaging positions IFP41 and IFP42.

In this way, with the line head 13 it is possible to prevent variation of the spot size on the light receiving surface 111. As a result, it is possible to prevent concentration unevenness of formed latent images.

FIG. 8 illustrates a case where the optical system 60 has an image-surface curvature. Specifically, the imaging position IFP10 of the light L1, the imaging position IFP20 of the light L2, the imaging position IFP30 of the light L3, and the imaging position IFP40 of the light L4 are located on a curved image surface I. Therefore, the imaging positions IFP10 and IFP40 and the imaging positions IFP20 and IFP30 are offset from each other in the optical axis direction.

More specifically, as illustrated in FIGS. 5 and 6, among the four light-emitting elements 74 (74*a*, 74*b*, 74*c*, and 74*d*) arranged linearly in the main-scanning direction, two light-emitting elements 74*b* and 74*c* are located at positions close to the optical axis 601 of the optical system 60, and the other two light-emitting elements 74*a* and 74*d* are located at positions distant from the optical axis 601. The light-emitting elements 74*a* and 74*d* and the light-emitting elements 74*b* and 74*c* have different angles of view. As a result, there is a case where the imaging positions IFP10 and IFP40 and the imaging positions IFP20 and IFP30 are sometimes offset in the optical axis direction (second direction) due to the image-surface curvature of the optical system 60.

In such a case, the above-described distance G1 between the imaging point FP1 and the imaging point FP2 (namely, the difference between the maximum value and the minimum value of the longitudinal aberration) is larger than the maximum value G2 of the offset amount. Therefore, even when the image surface I of the optical system 60 and the light receiving surface 111 are slightly offset in the optical axis direction, it is possible to decrease the difference on the light receiving surface 111 between the spot size of the light from the light-emitting element 74 which is positioned closer to the optical axis 601 and the spot size of the light from the light-emitting element 74 which is positioned distant from the optical axis 601.

Furthermore, even when the positional relationship between the image surface I of the optical system 60 and the light receiving surface 111 is offset or varied due to errors in mounting the line head 13 onto the body of the image forming apparatus 1, eccentricity of the photosensitive drum 11, or the like, it is possible to prevent a variation of the spot size on the light receiving surface 111, of the light from the light-emitting elements 74.

In particular, since the lens 64 which is located closest to the side of the light-emitting elements 74 has the above-described lens surface 62 having the first region 62*a* and the second region 62*b*, it is possible to prevent occurrence of a change in the above-mentioned advantage of suppressing a variation in the spot size between the light L1, L2, L3, and L4 (specifically, between the light L1 and L4, and between the light L2 and L3). Due to such a configuration, the line head 13 can exhibit excellent exposure characteristics in which the concentration unevenness is suppressed.

Having described the line head and the image forming apparatus according to the embodiments of the invention, the invention is not limited thereto. Each of the components provided in the line head and the image forming apparatus can be replaced with a component having an arbitrary configuration capable of realizing the same function. In addition, an arbitrary structure may be added.

Furthermore, in the lens arrays, a plurality of lenses is not limited to being arranged in a matrix of two rows by n columns. For example, a plurality of lenses in each of the lens arrays may be arranged in a matrix of three rows by n columns, four rows by n columns, and the like.

Moreover, one optical system may be configured by a plurality of lenses, and may be configured to have one or three or more lens surfaces.

Furthermore, in the above-described embodiment, although the light-emitting elements are described as being arranged in a matrix of one row by n columns for convenience of explanation, the arrangement is not limited to this, and the light-emitting elements may be arranged in a matrix of two rows by n columns, three rows by n columns, and the like.

EXAMPLES

Hereinafter, specific examples of the invention will be described.

Example

Figure 9:
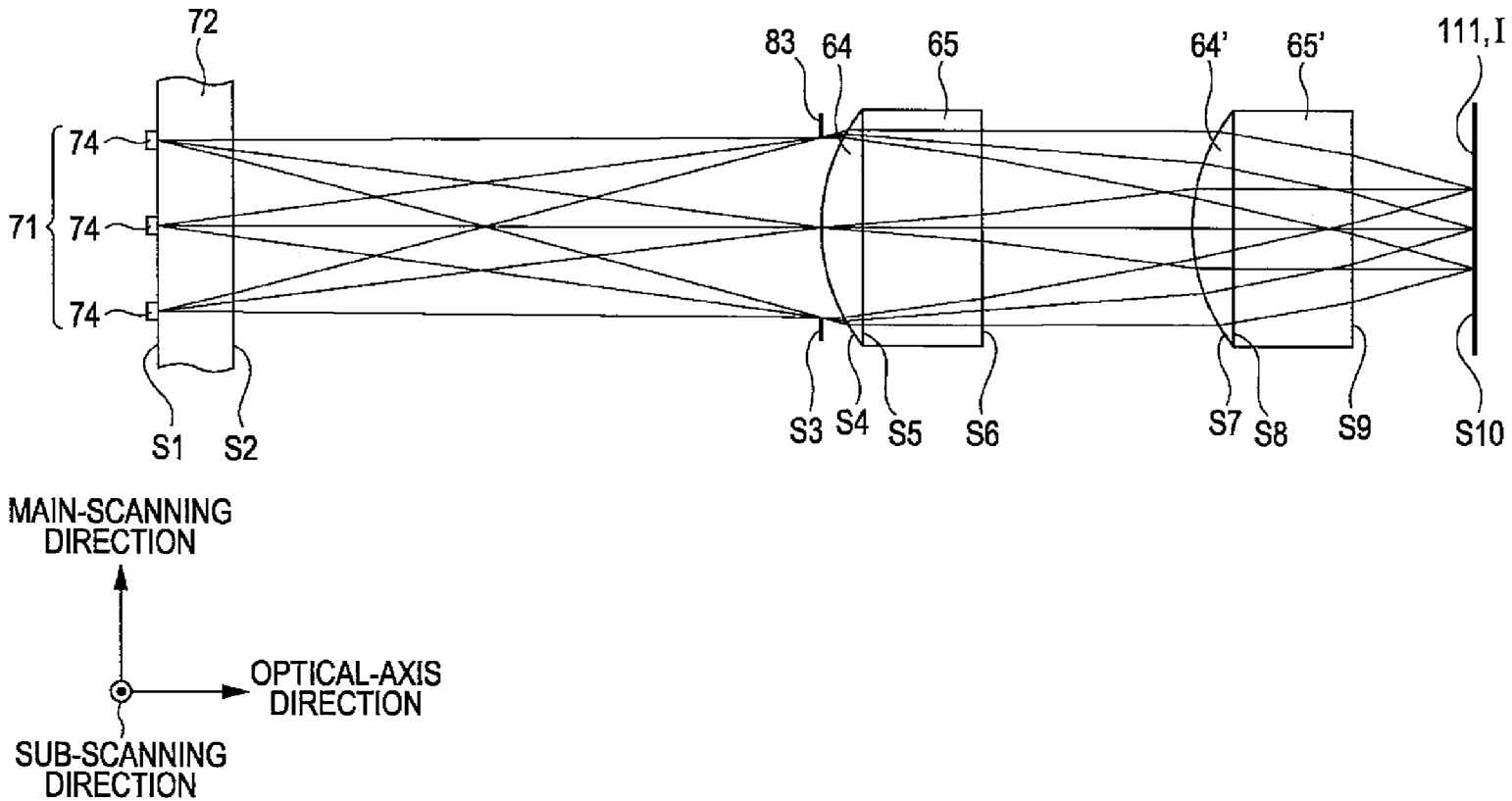
FIG. 9 is a view illustrating an optical system included in a line head according to Example of the invention.

A line head having the optical system as illustrated in FIG. 9 was produced. FIG. 9 is a cross-sectional view taken along the main-cross section, illustrating the optical system included in the line head according to Example of the invention.

The line head of the present example had the same configuration as the line head illustrated in FIGS. 3 and 5, except that three light-emitting elements 74 were arranged in the main-scanning direction.

Here, in the main-cross section, the three light-emitting elements 74 arranged in the main-scanning direction were arranged symmetrically to the optical axis.

Moreover, a glass material was used as the constituent material of the support portions 65 and 65', and a resin material was used as the constituent material of the lenses 64 and 64'.

The surface configuration of the optical system of the line head is shown in Table 1.

TABLE 1

| Surface number | Curvature at the center of main-cross section | Surface spacing | Refractive index at reference wavelength |
|---|---|---|---|
| S1: Light source plane | r1 = ∞ | d1 = 0.55 | n1 = 1.499857 |
| S2: Emission surface of glass substrate | r2 = ∞ | d2 = 4.2535 | |
| S3: Aperture diaphragm | r3 = ∞ | d3 = 0.01 | |
| S4: Incidence surface of resin portion | r4 = (separately described for each surface shape) | d4 = 0.3 | n4 = 1.525643 |
| S5: Resin-glass boundary surface | r5 = ∞ | d5 = 0.9 | n5 = 1.536988 |
| S6: Emission surface of glass substrate | r6 = ∞ | d6 = 1.4276 | |
| S7: Incidence surface of resin portion | r7 = (separately described for each surface shape) | d7 = 0.3 | n7 = 1.525643 |
| S8: Resin-glass boundary surface | r8 = ∞ | d8 = 0.9 | n8 = 1.536988 |
| S9: Emission surface of glass substrate | r9 = ∞ | d9 = 0.886270 | |
| S10: Image surface | r10 = ∞ | | |

As illustrated in FIG. 9, in Table 1, a surface S1 is a boundary surface (light source plane) of the light-emitting element 74 and the supporting plate 72, a surface S2 is a surface (emission surface of a glass substrate) of the supporting plate 72 opposite to the light-emitting element 74, a surface S3 is a surface (aperture diaphragm) of the diaphragm member 83 close to the light-emitting element 74, a surface S4 is the lens surface 62 (incidence surface of a resin portion) of the lens 64, a surface S5 is a boundary surface (resin-glass boundary surface) of the lens 64 and the support portion 65, a surface S6 is a surface (emission surface of the glass substrate) of the support portion 65 opposite to the lens, 64, a surface S7 is the lens surface 62' (incidence surface of the resin portion) of the lens 64', a surface S8 is a boundary portion (resin-glass boundary surface) of the lens 64' and the support portion 65', a surface S9 is a surface (emission surface of the glass substrate) of the support portion 65' opposite to the lens 64', and a surface S10 is the light receiving surface 111 (image surface).

Moreover, a surface spacing d1 is a spacing between the surface S1 and the surface S2, a surface spacing d2 is a spacing between the surface S2 and the surface S3, a surface spacing d3 is a spacing between the surface S3 and the surface S4, a surface spacing d4 is a spacing between the surface S4 and the surface S5, a surface spacing d5 is a spacing between the surface S5 and the surface S6, a surface spacing d6 is a spacing between the surface S6 and the surface S7, a surface spacing d7 is a spacing between the surface S7 and the surface S8, a surface spacing d8 is a spacing between the surface S8 and the surface S9, and a surface spacing d9 is a spacing between the surface S9 and the surface S10.

Furthermore, the reference wavelength refractive indexes refer to the refractive indexes on the respective surfaces facing the light having the reference wavelength.

The wavelength (reference wavelength) of the light emitted from the light-emitting element 74 was 690 nm, the object-side numerical aperture was 0.153, the total width of the object-side pixel group in the main-scanning direction was 1.176 mm, the total width of the object-side pixel group in the sub-scanning direction was 0.127 mm, and the optical magnification of the optical system 60 was −0.5039.

Furthermore, the lens surface 62 of the lens 64 was configured such that a range of regions within a radius of 0 to 0.604 mm around the optical axis was defined as the first region, and a range of regions outside the radius 0.604 mm around the optical axis was defined as the second region. The surface shapes of the respective regions were defined using the coefficients shown below in the definition formula given by Formula 1.

Coefficients of the definition formula of the first region of the lens surface 62 c=1/1.498749
K=−0.99931244
A=−0.01825629
B=0.083801118
C=−0.1
Δ=0.0

Coefficients of the definition formula of the second region of the lens surface 62 c=1/1.517423
K=−1.21004
A=−0.007269
B=0.0
C=0.0
Δ=0.001385889

Furthermore, the surface shape of the lens surface 62' of the lens 64' was defined using the coefficients shown below in the definition formula given by Formula 2.

Coefficients of the definition formula of the lens surface 62' c=1/1.41337
K=−3.8946025
A=0.03959898
B=0.035508266
C=0.11256865
D=0.2034097
E=0.1094741
F=−0.07921190
G=−0.2126654
H=−0.2376198
I=−0.078115926

Figure 10:
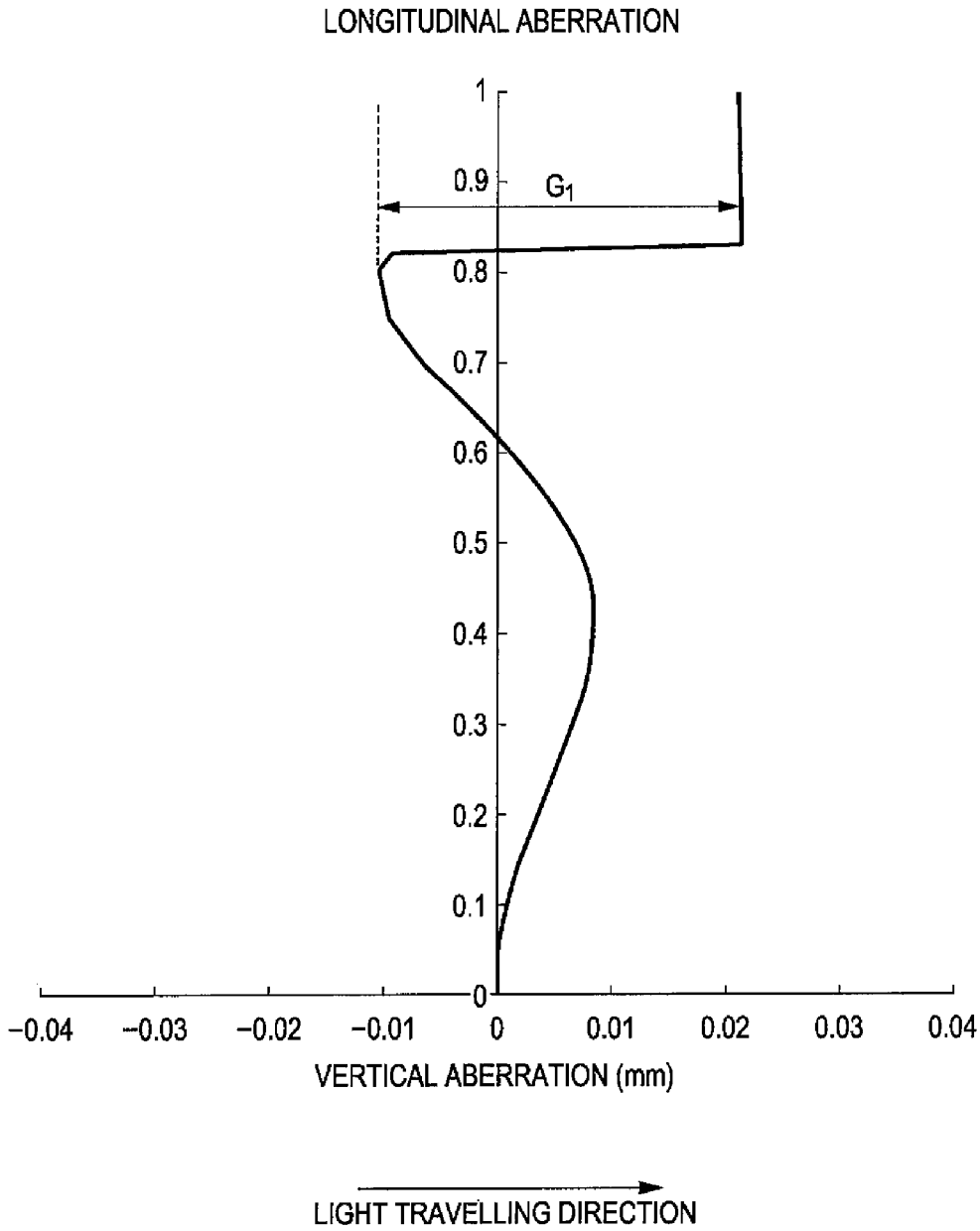
FIG. 10 is a graph illustrating the longitudinal aberration of an optical system included in a line head according to Example of the invention.

The optical system obtained in the above-described manner had a longitudinal aberration as shown in FIG. 10. In FIG. 10, the horizontal axis is defined such that, when the 0 (reference) point of the horizontal axis corresponds to a longitudinal aberration in the vicinity of the optical axis, the left side is the light source side and the right side is the image side. The vertical axis represents the separation distance of the ray of light having passed through the diaphragm member (aperture diaphragm) 83 from the optical axis.

Comparative Example

A line head was produced similar to the above-described example, except that the surface shape of the lens surface 62 of the lens 64 was made identical to the surface shape of the lens surface 62' of the lens 64'.

Evaluation

Figure 11A:
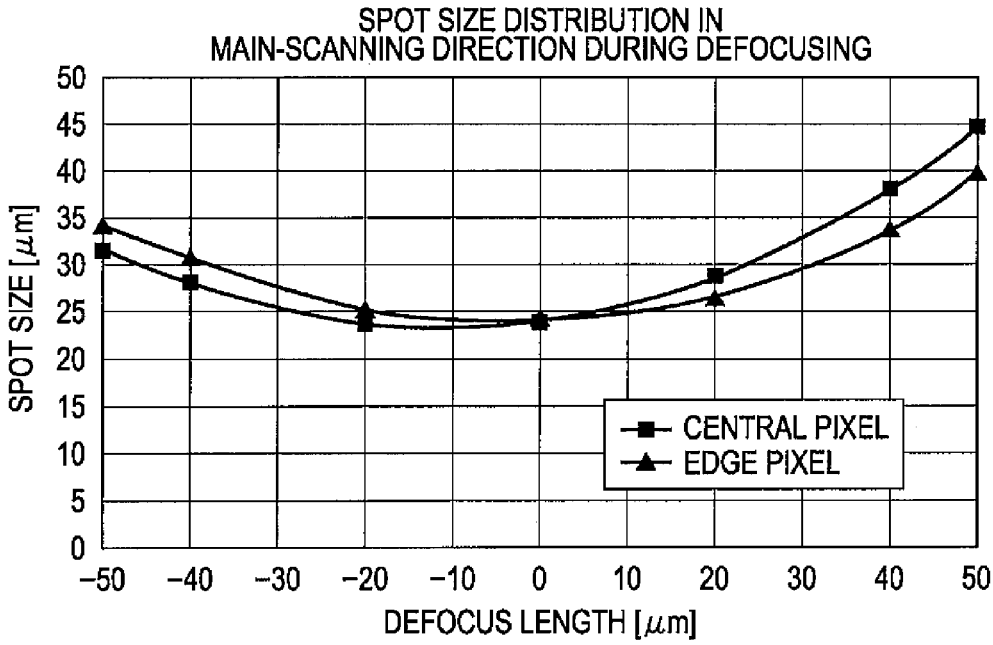
FIGS. 11A and 11B are graphs illustrating the spot sizes in the vicinity of a photoconductor surface (an image surface), respectively, of the optical system of the line head of Example of the invention and the optical system of the line head of Comparative Example.
Figure 11B:
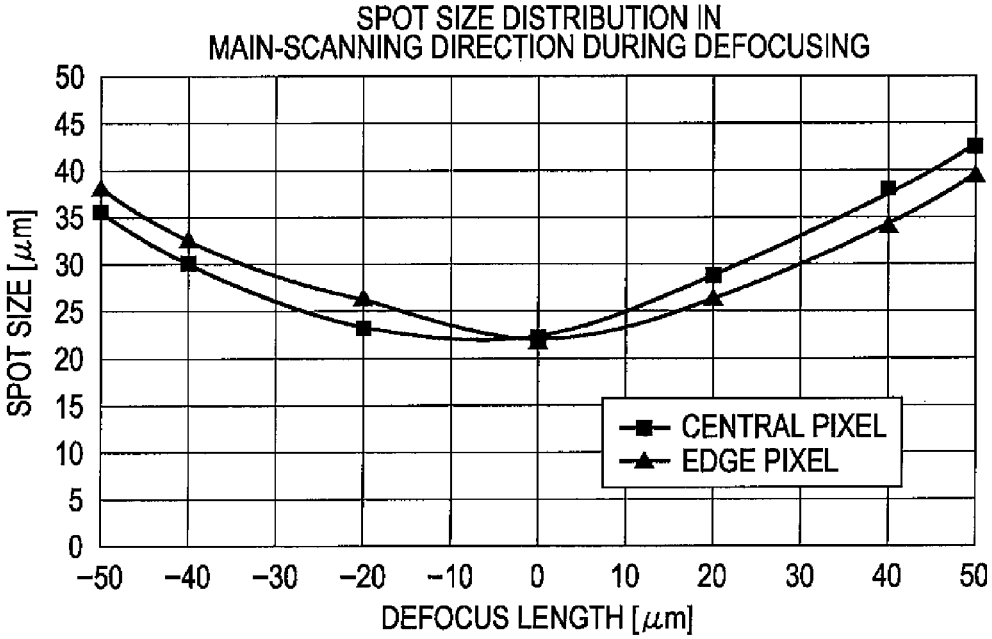

FIGS. 11A and 11B respectively illustrate changes in the spot sizes at various positions in the optical axis direction of the optical systems of the example and the comparative example. FIG. 11A is for the example of the invention, and FIG. 11B is for the comparative example.

As is obvious from FIGS. 11A and 11B, the line head (optical system) of the example according to the invention was better able to suppress a change in the spot size in the vicinity of the minimum spot size than the line head of the comparative example.

Moreover, the line heads of the example and the comparative example were mounted on the image forming apparatuses as shown in FIG. 1, and images were formed using the respective image forming apparatuses. With the image forming apparatus of the example, it was possible to obtain higher-quality images in which concentration unevenness was not observed, compared to the image forming apparatus of the comparative example.

The entire disclosure of Japanese Patent Applications No. 2009-009384, filed on Jan. 19, 2009 is expressly incorporated by reference herein.

What is claimed is:

1. A line head comprising:

light-emitting elements arranged in a first direction;

an aperture diaphragm; and an optical system that images light emitted from the light-emitting elements on an image surface, wherein:

the aperture diaphragm and the optical system are arranged in a second direction that is orthogonal to or substantially orthogonal to the first direction; and among lenses included in the optical system, a lens located at the position closest to the aperture diaphragm is a multifocal lens.

2. The line head according to claim 1, wherein the multifocal lens has a lens surface including a first region and a second region which are defined by different definition formulas.

3. The line head according to claim 2, wherein the first region is provided in a central portion of the lens surface, and the second region is provided so as to surround the periphery of the first region.

4. The line head according to claim 2, wherein the lens surface has a rotationally symmetrical shape.

5. The line head according to claim 2, wherein the lens surface including the first region and the second region is a lens surface which is located at the position closest to the light-emitting elements.

6. The line head according to claim 2, wherein the first region has a larger area than the second region.

7. The line head according to claim 1, wherein:

the optical system has imaging points which are located at different positions in the second direction;

a distance in the second direction between a imaging point, which is located furthest from the optical system in the second direction among the imaging points, and a imaging point, which is located closest to the optical system in the second direction, is larger than the minimum spot size of light which is emitted from the light-emitting elements to converge in the optical system.

8. An image forming apparatus comprising:

a latent image carrier on which a latent image is formed; and a line head, the line head comprising:

light-emitting elements arranged in a first direction;

an aperture diaphragm; and an optical system that images light emitted from the light-emitting elements on a latent image carrier, wherein:

the aperture diaphragm and the optical system are arranged in a second direction that is orthogonal to or substantially orthogonal to the first direction; and among lenses included in the optical system, a lens located at the position closest to the aperture diaphragm is a multifocal lens.

* * * * *